US010649376B2

(12) United States Patent
Jota et al.

(10) Patent No.: US 10,649,376 B2
(45) Date of Patent: May 12, 2020

(54) IMAGE HEATING APPARATUS AND IMAGE FORMING APPARATUS

(71) Applicant: CANON KABUSHIKI KAISHA, Tokyo (JP)

(72) Inventors: Yusuke Jota, Kawasaki (JP); Atsushi Iwasaki, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/388,414

(22) Filed: Apr. 18, 2019

(65) Prior Publication Data

US 2019/0324389 A1 Oct. 24, 2019

(30) Foreign Application Priority Data

Apr. 19, 2018 (JP) ..... 2018-080534

(51) Int. Cl.
*G03G 15/20* (2006.01)
*G03G 15/00* (2006.01)

(52) U.S. Cl.
CPC ..... *G03G 15/2039* (2013.01); *G03G 15/2053* (2013.01); *G03G 15/2064* (2013.01); *G03G 15/5004* (2013.01); *G03G 2215/2035* (2013.01)

(58) Field of Classification Search
CPC ..... G03G 15/2042; G03G 15/2046; G03G 15/2039
See application file for complete search history.

(56) References Cited

U.S. PATENT DOCUMENTS

| | | | | |
|---|---|---|---|---|
| 8,942,589 | B2 | 1/2015 | Asami et al. | |
| 10,054,882 | B2 | 8/2018 | Nomura et al. | |
| 10,114,318 | B2 | 10/2018 | Sako et al. | |
| 10,185,258 | B2 | 1/2019 | Sako et al. | |
| 10,268,144 | B2 | 4/2019 | Iwasaki | |
| 2003/0156866 | A1* | 8/2003 | Shida | G03G 15/2053 399/328 |
| 2012/0308253 | A1* | 12/2012 | Kurata | G03G 15/2042 399/69 |
| 2013/0195494 | A1* | 8/2013 | Asami | G03G 15/2042 399/70 |
| 2015/0286174 | A1* | 10/2015 | Yamamoto | G03G 15/2039 399/69 |
| 2018/0341202 | A1 | 11/2018 | Nomura et al. | |
| 2019/0049881 | A1 | 2/2019 | Sako et al. | |
| 2019/0107801 | A1 | 4/2019 | Sako et al. | |

FOREIGN PATENT DOCUMENTS

| | | | |
|---|---|---|---|
| JP | H04-274473 | A | 9/1992 |
| JP | 2013-156570 | A | 8/2013 |
| JP | 2015-059992 | A | 3/2015 |
| JP | 2015-064548 | A | 4/2015 |
| JP | 2015-087566 | A | 5/2015 |

* cited by examiner

*Primary Examiner* — Sevan A Aydin
(74) *Attorney, Agent, or Firm* — Venable LLP

(57) ABSTRACT

When a nip portion has a region through which a recording material passes, and a part of the region is an image heating region where an image region on the recording material passes through, and the rest of the region is a non-image heating region where a non-image region on the recording material passes through, a control portion controls heating elements corresponding to the non-image heating region, out of the plurality of heating elements, so as to maintain a control target temperature, which is set based on the amount of the image heating apparatus used.

10 Claims, 20 Drawing Sheets

FIG. 6B <CLASSIFICATION BASED ON IMAGE INFORMATION>

| $A_1$ | $A_2$ | $A_3$ | $A_4$ | $A_5$ | $A_6$ | $A_7$ |
|---|---|---|---|---|---|---|
| AP | AI | AI | AI | AI | AI | AP |

FIG.11B <CLASSIFICATION OF HEATING REGION BASED ON IMAGE INFORMATION>

| A1 | A2 | A3 | A4 | A5 | A6 | A7 |
|---|---|---|---|---|---|---|
| AP | AP | AP | AI | AP | AP | AP |

FIG.17B <CLASSIFICATION BASED ON IMAGE INFORMATION>

| A1 | A2 | A3 | A4 | A5 | A6 | A7 |
|---|---|---|---|---|---|---|
| AI | AI | AI | AI | AI | AI | AP |

IMAGE HEATING APPARATUS AND IMAGE FORMING APPARATUS

BACKGROUND OF THE INVENTION

Field of the Invention

The present invention relates to an image forming apparatus using an electrophotographic system, such as a printer and a copier. The present invention also relates to an image heating apparatus, such as a gloss applying apparatus, to enhance a gloss value of a toner image, by reheating a toner image fixed to a fixing unit included in an image forming apparatus or to a recording material.

Description of the Related Art

In image heating apparatuses, such as a fixing unit and a gloss applying apparatus, used for such an electrophotographic image forming apparatus as a printer and a copier (hereafter "image forming apparatus"), a system of selectively heating an image portion formed on the recording material has been proposed to meet demand to conserve power (Japanese Patent Application Publication No. 2015-059992). In this method, the heater includes a plurality of heating elements which are disposed in the longer direction (direction perpendicular to the transporting direction of the recording material), and heating of each heating element is selectively controlled in accordance with the image information on the recording material. In other words, conserving power is attempted for the image heating apparatus by setting a control temperature of a non-image region where no image exists to be lower than a control temperature of an image region where an image exists on the recording material.

Further, a system that creates the shape of a pressure roller (pressure rotating member) which forms a fixing nip portion with a fixing member, to be an inverted crown shape (Japanese Patent Application Publication No. H04-274473). In other words, the outer diameter of the pressure roller gradually increases from the center toward the ends in the longer direction. By this system, the recording material is transported relatively faster on the ends than in the center in the longer direction when the recording material is transported in the nip portion, so that generation of distortion and warping of the recording material in the nip portion are suppressed, and generation of wrinkles in the recording material is suppressed.

SUMMARY OF THE INVENTION

However, as the amount of the image heating apparatus used increases, the inverted crown amount (difference between the maximum diameter at the ends and the minimum diameter at the center) gradually decreases, and any effect to suppress generation of wrinkles in the recording material diminishes, hence the inverted crown amount of the pressure roller becomes one factor that determines the lifespan of the image heating apparatus.

It is an object of the present invention to provide a technique to suppress generation of wrinkles in the recording material, regardless the amount of the image heating apparatus used, and implement both a longer lifespan and conserving power for the image heating apparatus.

To achieve this object, the image heating apparatus of the present invention includes:

a heating unit which includes a heater having a plurality of heating elements arranged in a direction perpendicular to a transporting direction of a recording material, and heats an image formed on the recording material using the heat of the heater;

a pressure member which forms a nip portion by press-contacting the heating unit, and rotates, the pressure member having circumference increasing from the center portion toward the ends in the arrangement direction of the plurality of heating elements; and a control portion which controls power supplied to each of the plurality of heating elements individually, wherein when the nip portion has a region through which the recording material passes, and a part of the region is an image heating region where an image region on the recording material passes through, and e is a non-image heating region where a non-image region on the recording material passes through, the control portion controls power supplied to the heating elements corresponding to the non-image heating region, out of the plurality of heating elements, so as to maintain a control target temperature, which is set based on the amount of the image heating apparatus used.

To achieve this object, the image forming apparatus of the present invention includes:

an image forming portion which forms an image on a recording material; and a fixing portion which fixes the image formed on the recording material to the recording material, wherein the fixing portion is the image heating apparatus of the present invention.

According to the present invention, generation of wrinkles in the recording material can be suppressed, regardless the amount of the image heating apparatus used, and both a longer lifespan and conserving power can be implemented for the image heating apparatus.

Further features of the present invention will become apparent from the following description of exemplary embodiments with reference to the attached drawings.

BRIEF DESCRIPTION OF THE DRAWINGS

FIGS. 6A and 6B are diagrams depicting a concrete example of classification of the heating region according to Example 1;

FIGS. 11A and 11B are diagrams depicting a concrete example of the classification of the heating region according to an application example of Example 1;

FIGS. 17A and 17B are diagrams depicting a concrete example of the classification of the heating region according to an application example of Example 2.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Example 1

1. General Configuration of Image Forming Apparatus

Figure 1:
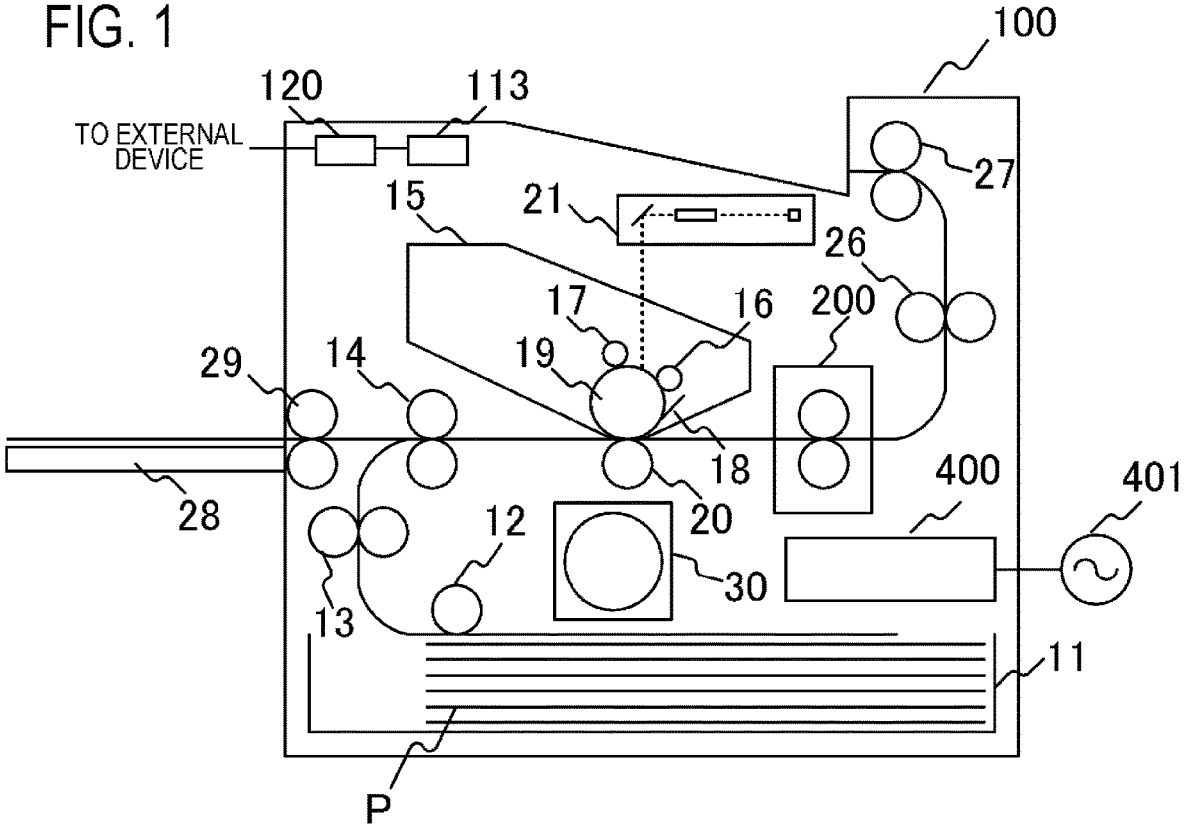
FIG. 1 is a schematic cross-sectional view depicting an image forming apparatus according to an example of the present invention.

A general configuration of an image forming apparatus will be described with reference to FIG. 1. FIG. 1 is a schematic cross-sectional front view of the image forming apparatus. Examples of the image forming apparatus to which the present invention can be applied are a printer and a copier, which use an electrophotographic system or an electrostatic recording system. Here, a case of applying the present invention to a laser printer, which forms an image on a recording material P using an electrophotographic system, will be described.

The image forming apparatus 100 includes a video controller 120 and a control portion 113. The video controller 120 is an acquiring unit which acquires information on an image formed on the recording material, and receives and processes image information and print instructions which are sent from an external device, such as a personal computer. The control portion 113 is connected to the video controller 120, and controls each portion of the image forming apparatus 100 in accordance with the instruction from the video controller 120. When the video controller 120 receives a print instruction from the external device, an image is formed by the following operation.

When the image forming apparatus main unit 100 receives a print signal, a scanner unit 21 emits a laser light modulated based on the image information of the print signal, and scans the surface of a photosensitive drum 19, which is charged to a predetermined polarity by a charging roller 16. Thereby an electrostatic latent image is formed on the photosensitive drum 19. Then toner is supplied from a developing roller 17 to this electrostatic latent image, whereby the electrostatic latent image on the photosensitive drum 19 is developed as a toner image. Recording material (recording paper) P stacked in a paper feeding cassette 11 is fed one-by-one by a pickup roller 12, and is transported to a resist roller pair 14 by a transport roller pair 13. Further, the recording material P is transferred from the resist roller pair 14 to a transfer position so as to match a timing when the toner image on the photosensitive drum 19 reaches the transfer position, formed by the photosensitive drum 19 and the transfer roller 20. While the recording material P is passing through the transfer position, the toner image on the photosensitive drum 19 is transferred to the recording material P. Then the recording material P is heated by a fixing apparatus 200 as an image heating apparatus and an image heating portion, and the toner image is heated and fixed to the recording material P. The recording material P bearing the fixed toner image is ejected by the transport roller pair 26 and 27 to a tray located in an upper part of the image forming apparatus 100. A drum cleaner 18 cleans the toner remaining on the photosensitive drum 19. A paper feeding tray 28 (manual insert tray), which includes a pair of recording material regulating plates of which width can be adjusted in accordance with the size of the recording material P, is disposed to support the recording material P of which size is other than a standard size. A pickup roller 29 feeds the recording material P from the paper feeding tray 28. The image forming apparatus main unit 100 includes a motor 30 which drives the fixing apparatus 200 and the like. A heater driving unit connected to a commercial AC power supply 401 and a control circuit 400 (energization control unit) supply power to the fixing apparatus 200. The photosensitive drum 19, the charging roller 16, the scanner unit 21, the developing roller 17, and the transfer roller 20 constitute an image forming portion which forms an unfixed image on the recording material P. In Example 1, a developing unit which includes the photosensitive drum 19, the charging roller 16 and the developing roller 17, and a cleaning unit which includes the drum cleaner 18, constitute a process cartridge 15, which is detachably attached to the main unit of the image forming apparatus 100.

2. Configuration of Image Heating Apparatus

Figure 2:
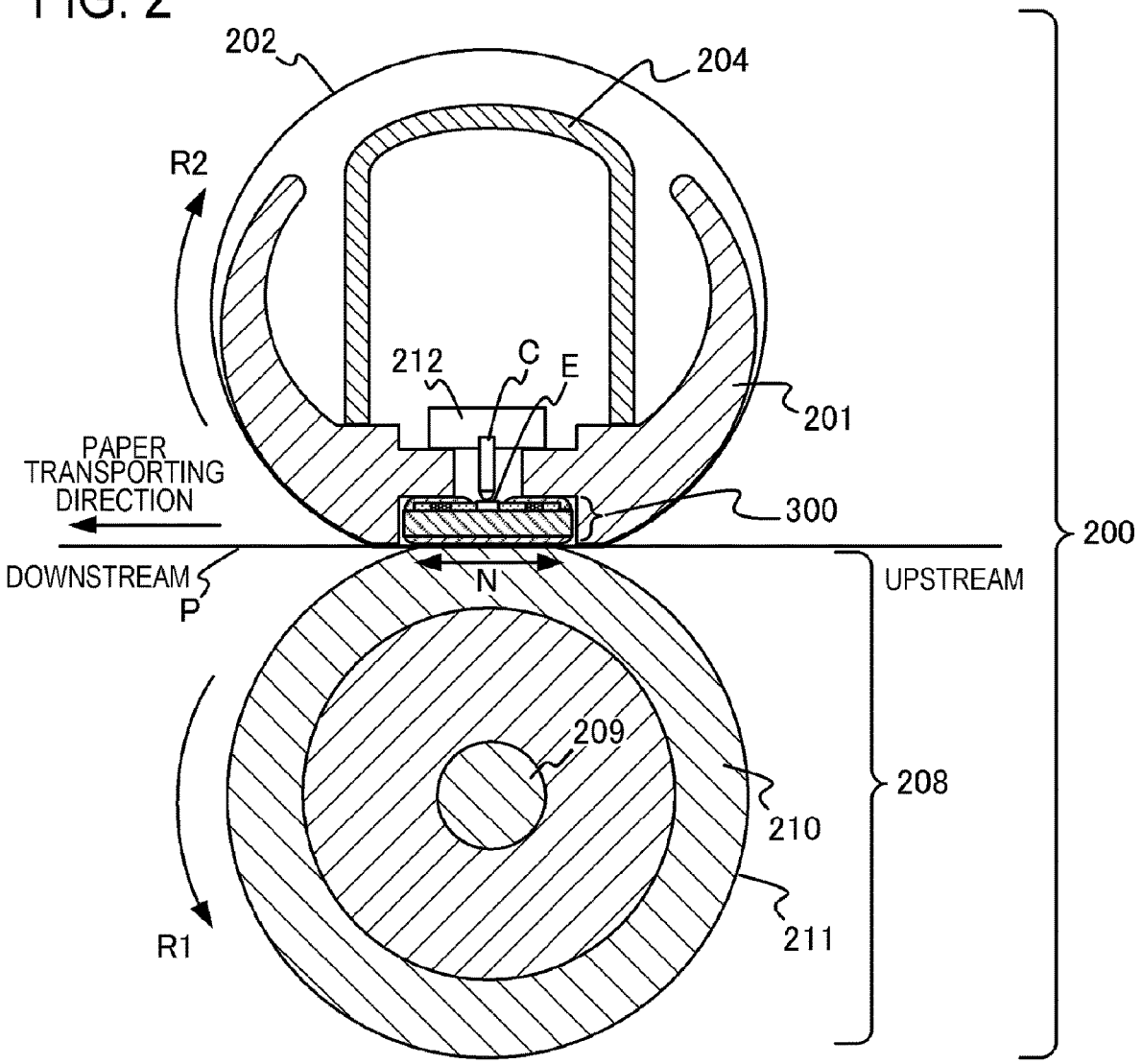
FIG. 2 is a cross-sectional view depicting an image heating apparatus according to Example 1.

FIG. 2 is a schematic cross-sectional view of the fixing apparatus 200 (image heating apparatus) of Example 1. The fixing apparatus 200 includes: a fixing film 202 (endless belt); a heater 300 which contacts the inner surface of the fixing film 202, a pressure roller 208 which forms the fixing nip portion N with the heater 300 via the fixing film 202; and a metal stay 204. The fixing film 202, the heater 300 and various composing elements disposed on the inner side of the fixing film 202 correspond to the heating member according to the present invention and establish the heating unit according to the present invention, and the pressure roller 208 corresponds to the pressure member according to the present invention.

The fixing film 202 is a tubular multilayer heat-resistant film, and has a base layer made of a heat-resistant resin (e.g. polyimide) or a metal (e.g. stainless steel). On the surface of the fixing film 202, a release layer is formed by coating a heat-resistant resin having good releasability, such as a tetrafluoroethylene-perfluoroalkylvinylether copolymer (PFA), so as to prevent the attachment of toner and to ensure separation from the recording material P. Further, in the case of an apparatus which forms color images, a heat-resistant rubber (e.g. silicon rubber) may be formed as an elastic layer between the base layer and the release layer, in order to improve image quality. The fixing film 202 of Example 1 has a 24 mm outer diameter, where the base layer is made of polyimide and has a 70 μm thickness, the elastic layer is made of silicon rubber and has a 200 μm thickness, and the release layer is made of PFA and has a 15 μm thickness.

The pressure roller 208 includes a core metal 209 made of such material as iron, SUS and aluminum, and an elastic layer 210 made of such material as silicon rubber. On the surface of the pressure roller 208, a release layer 211 is formed by coating a heat-resistant resin having good releasability, such as a tetrafluoroethylene-perfluoroalkylvinylether copolymer (PFA), so as to prevent the attachment of toner. In Example 1, the outer diameter of the pressure roller 208 is 25 mm at the center position where the diameter is the minimum (minimum circumference), and gradually increases as the position on the pressure roller 208 becomes closer to both ends, becoming 25.16 mm at both ends where the diameter is the maximum (maximum circumference). In other words, the pressure roller 208 of Example 1 has an inverted crown shape. This shape generates a peripheral speed difference between the center portion and both ends in the pressure roller 208, whereby an appropriate tension is applied, from the center portion to both ends of the recording material P held by the fixing nip portion N, in the longer direction perpendicular to the transporting direction of the recording material P. By the force to stretch the recording material P in the longer direction from the center to the ends, generation of wrinkles in the recording material P is suppressed, and transportability of the recording material P in the fixing nip portion N can be stabilized. The core metal 209 is made of SUS, and the outer diameter is a consistent 17 mm. The elastic layer 210 formed on the outer surface of the core metal 209 is made of silicon rubber, of which thickness is 4 mm at the center portion, and gradually increases as the position on the core metal 209 becomes closer to both ends, becoming 4.08 mm at both ends. In other words, the pressure roller 208 is formed in an inverted crown shape as the layer thickness of the elastic layer 210 changes in the axis direction. The release layer 211, which is formed on the surface of the elastic layer 210, is made of PFA and has a 20 μm thickness.

A degree of the inverted crown shape of the pressure roller 208 (inverted crown amount) is defined as follows.

(Inverted crown amount)=(outer diameter at both ends of pressure roller 208)−(outer diameter at center portion of pressure roller 208)

The pressure roller 208 tends to expand and deform due to the heat of the heater 300, especially at both ends thereof in the longer direction, where temperature easily rises. Therefore the inverted crown amount tends to increase as heating continues. On the other hand, in some cases, the control temperature at both ends of the fixing nip portion N may be kept low in order to prevent problems generated by temperature rising at the ends or to conserve energy. If this control is performed, heating at the edges of the pressure roller 208 is suppressed, and the inverted crown amount, that is required to transport the recording material, may in some cases not be ensured.

The heater 300 is held in a heater holding member 201 made of heat-resistant resin, and heats heating regions $A_1$ to $A_7$ (details described later) disposed in the fixing nip portion N, whereby the fixing film 202 is heated. The heater holding member 201 also has a guide function to guide rotation of the fixing film 202. The heater 300 also includes an electrode E disposed on the opposite side of the fixing nip portion N, and supplies power to the electrode E via an electric contact C. The metal stay 204 receives a pressing force (not illustrated), and energizes the heater holding member 201 toward the pressure roller 208. Then the pressure roller 208, as a part of the heating unit, press-contacts the fixing film 202, whereby the fixing nip portion is formed. Furthermore, a thermo-switch, which is activated by an abnormal heating of the heater 300 and which stops power supplied to the heater 300, and a safety element 212, such as a temperature fuse, directly contact the heater 300, or indirectly contact the heater 300 via the heater holding member 201.

The pressure roller 208 receives power from the motor 30 and rotates in the arrow R1 direction. By the rotation of the pressure roller 208, the fixing film 202 follows and rotates in the arrow R2 direction. The fixing nip portion N holds and transports the recording material P while the heat of the fixing film 202 is transferred to the recording material P, whereby the unfixed toner image on the recording material P is fixed. A sliding grease (not illustrated) having high heat resistance is disposed between the heater 300 and the fixing film 202, so as to ensure the slidability of the fixing film 202, and to obtain a stable driven-rotation state.

3. Configuration of Heater

Figure 3A:
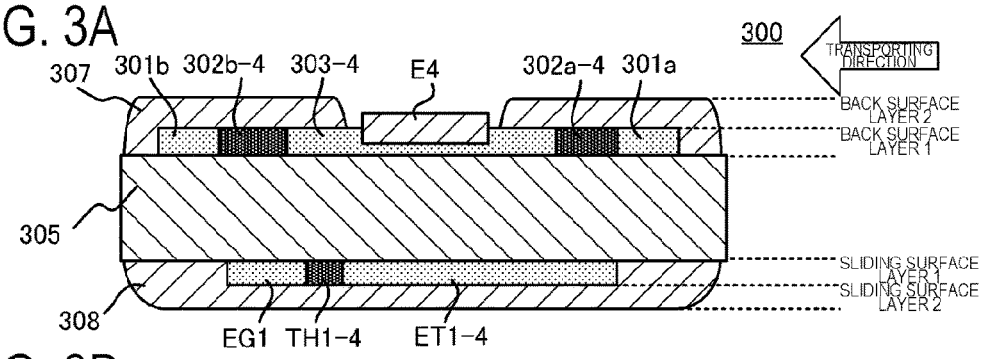
FIGS. 3A to 3C indicate a configuration of a heater according to Example 1.
Figure 3B:
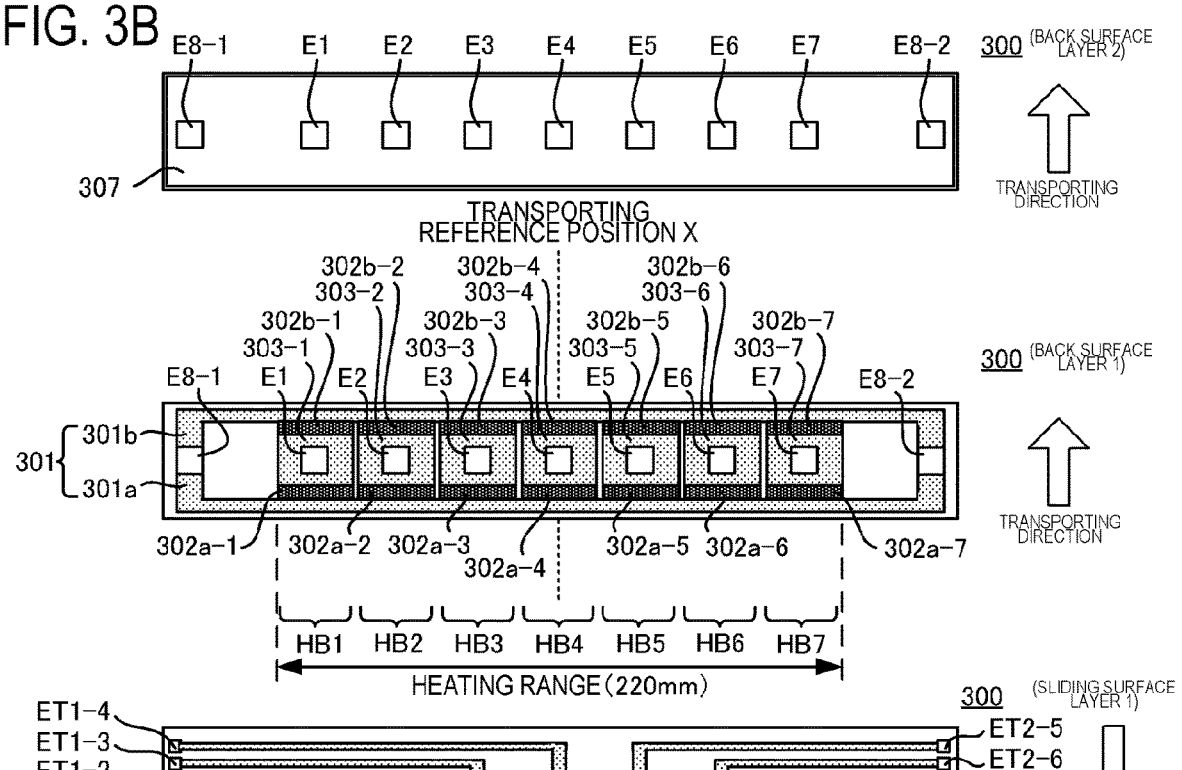
Figure 3B:
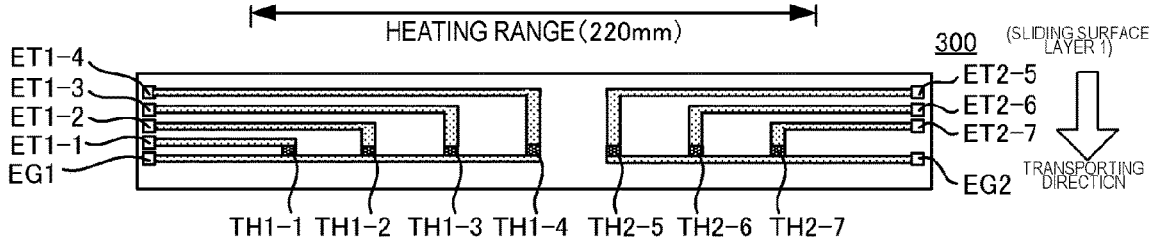
Figure 3B:
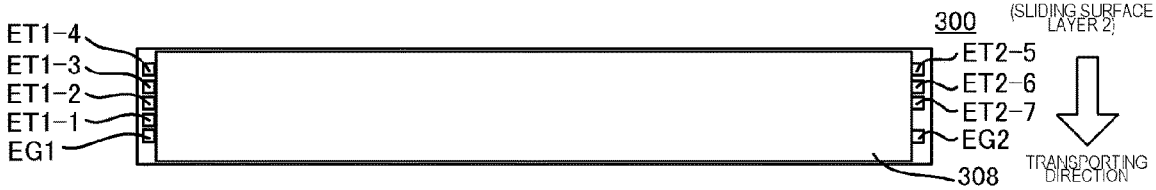
Figure 3C:
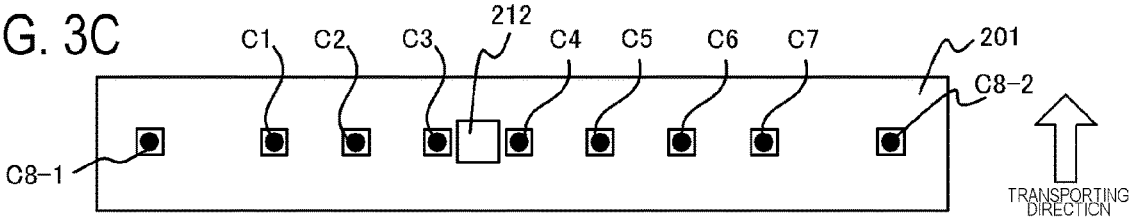

A configuration of the heater 300 according to Example 1 will be described with reference to FIGS. 3A to 3C. FIG. 3A is a cross-sectional view of the heater 300, FIG. 3B is a plan view of each layer of the heater 300, and FIG. 3C is a diagram depicting a method of connecting the electric contacts C to the heater 300. In FIG. 3B, a transporting reference position X, to transport the recording material P in the image forming apparatus 100 of Example 1, is indicated. The transporting reference in Example 1 is at the center, and the recording material P is transported such that the center line, perpendicular to the transporting direction, is located at the transporting reference position X. FIG. 3A is a cross-sectional view of the heater 300 at this transporting reference position X.

The heater 300 is constituted by a ceramic substrate 305, a back surface layer 1 disposed on the substrate 305, a back surface layer 2 which covers the back surface layer 1, a sliding surface layer 1 disposed on the surface of the substrate 305 on the opposite side of the back surface layer 1, and a sliding surface layer 2 which covers the sliding surface layer 1.

The back surface layer 1 includes conductors 301 (301*a*, 301*b*) which are disposed along the heater 300 in the longer direction. The conductor 301 is divided into the conductor 301*a* and the conductor 301*b*, and the conductor 301*b* is disposed on the downstream side of the conductor 301*a* in the transporting direction of the recording material P. The back surface layer 1 also includes conductors 303 (303-1 to 303-7) which are disposed in parallel with the conductors 301*a* and 301*b*. The conductor 303 is disposed between the conductor 301*a* and the conductor 301*b* along the longer direction of the heater 300.

Further, the back surface layer 1 includes heating elements 302*a* (302*a*-1 to 302*a*-7) and heating elements 302*b* (302*b*-1 to 302*b*-7). These are heating resistors which are heated by energization. The heating element 302*a* is disposed between the conductor 301 and the conductor 303, and generates heat by power which is supplied via the conductor 301*a* and the conductor 303. The heating element 302*b* is disposed between the conductor 301*b* and the conductor 303, and generates heat by power which is supplied via the conductor 301*b* and the conductor 303.

A heating area, which is constituted of the conductor 301, the conductor 303, the heating element 302*a* and the heating element 302*b*, is divided into seven heating blocks ($HB_1$ to $HB_7$) in the longer direction of the heater 300. In other words, the heating element 302*a* is divided into seven regions (heating elements 302*a*-1 to 302*a*-7) in the longer direction of the heater 300. The heating element 302*b* is divided into seven regions (heating elements 302*b*-1 to 302*b*-7) in the longer direction of the heater 300. Further, the conductor 303 is divided into seven regions (conductors 303-1 to 303-7) corresponding to the divided positions of the heating elements 302*a* and 302*b*. The heating value of each of the seven heating blocks ($HB_1$ to $HB_7$) is independently controlled by independently controlling the power supplied to the heating resistor in each block.

The heating range of Example 1 is from the left end of the heating block $HB_1$ to the right end of the heating block $HB_7$ in FIGS. 3A to 3C, and the total length thereof is 220 mm. The length of all heating blocks in the longer direction is the same (about 31 mm), but the length of an individual heating block may be different.

The back surface layer 1 also includes electrodes E (E1 to E7, E8-1 and E8-2). The electrodes E1 to E7 are disposed in the regions of the conductors 303-1 to 303-7 respectively, and supplies power to the heating blocks $HB_1$ to $HB_7$ via the conductors 303-1 to 303-7 respectively. The electrodes E8-1 and E8-2 are disposed so as to connect the conductor 301 to the ends of the heater 300 in the longer direction, and are used for supplying power to the heating blocks $HB_1$ to $HB_7$ via the conductor 301. In Example 1, the electrodes E8-1 and E8-2 are disposed on both ends of the heater 300 in the longer direction, but only the electrode E8-1 may be disposed on one end, for example. Further, in Example 1, power is supplied to the conductors 301*a* and 301*b* using a common electrode, but separate electrodes may be disposed for the conductor 301*a* and the conductor 301*b* respectively, so that power is supplied to the conductors 301*a* and 301*b* respectively.

The back surface layer 2 is formed of a surface protective layer 307 having an insulating property (glass in Example 1), and covers the conductor 301, the conductor 303 and the heating elements 302*a* and 302*b*. The surface protective layer 307 is formed excluding the areas of the electrodes E, so that the electric contacts C can be connected to the electrodes E from the back surface layer 2 side of the heater.

The sliding surface layer 1, which is disposed on the substrate 305 on the opposite side of the back surface layer 1, includes thermistors TH (TH1-1 to TH1-4 and TH2-5 to TH2-7) to detect the temperature of each heating block $HB_1$ to $HB_7$. The thermistors TH are made of a material having PTC characteristic or an NTC characteristic (NTC characteristic in the case of Example 1), and by detecting the resistance values of the thermistors TH, the temperature of all the heating blocks can be detected.

The sliding surface layer 1 includes conductors ET (ET1-1 to ET1-4 and ET2-5 to ET2-7) and conductors EG (EG1 and EG2), in order to supply power to the thermistors TH and detect the resistance values thereof. The conductors ET1-1 to ET1-4 are connected to the thermistors TH1-1 to TH1-4 respectively. The conductors ET2-5 to ET2-7 are connected to the thermistors TH2-5 to TH2-7 respectively. The conductor EG1 is connected to the four thermistors TH1-1 to TH1-4 and forms a common conductive path. The conductor EG2 is connected to the three thermistors TH2-5 to TH2-7 and forms a common conductive path. The conductors ET and the conductors EG are formed to the ends of the heater 300 in the longer direction respectively, and are connected to the control circuit 400 at the ends of the heater in the longer direction via the electric contacts (not illustrated).

The sliding surface layer 2 is formed of a surface protective layer 308 having a sliding property and an insulating property (glass in the case of Example 1), and covers the thermistors TH, the conductors ET and the conductors EG, while ensuring slidability with the inner surface of the fixing film 202. The surface protective layer 308 is formed excluding both ends of the heater 300 in the longer direction, so that the electric contacts are disposed for the conductors ET and the conductors EG.

A method of connecting each electric contact C to each electrode E will be described next. FIG. 3C is a plan view depicting the state of connecting each electric contact C to each electrode E viewed from the heater holding member 201 side. In the heater holding member 201, a through hole is formed at each position corresponding to the electrodes E (E1 to E7, E8-1 and E8-2). At each through hole position, each electric contact C (C1 to C7, C8-1 and C8-2) is electrically connected to each electrode E (E1 to E7, E8-1 and E8-2) respectively, by such a method as an energizing spring or welding. The electric contacts C are connected with the control circuit 400 of the heater 300 (described later) via a conductive material (not illustrated) disposed between the metal stay 204 and the heater holding member 201.

4. Configuration of Heater Control Circuit

Figure 4:
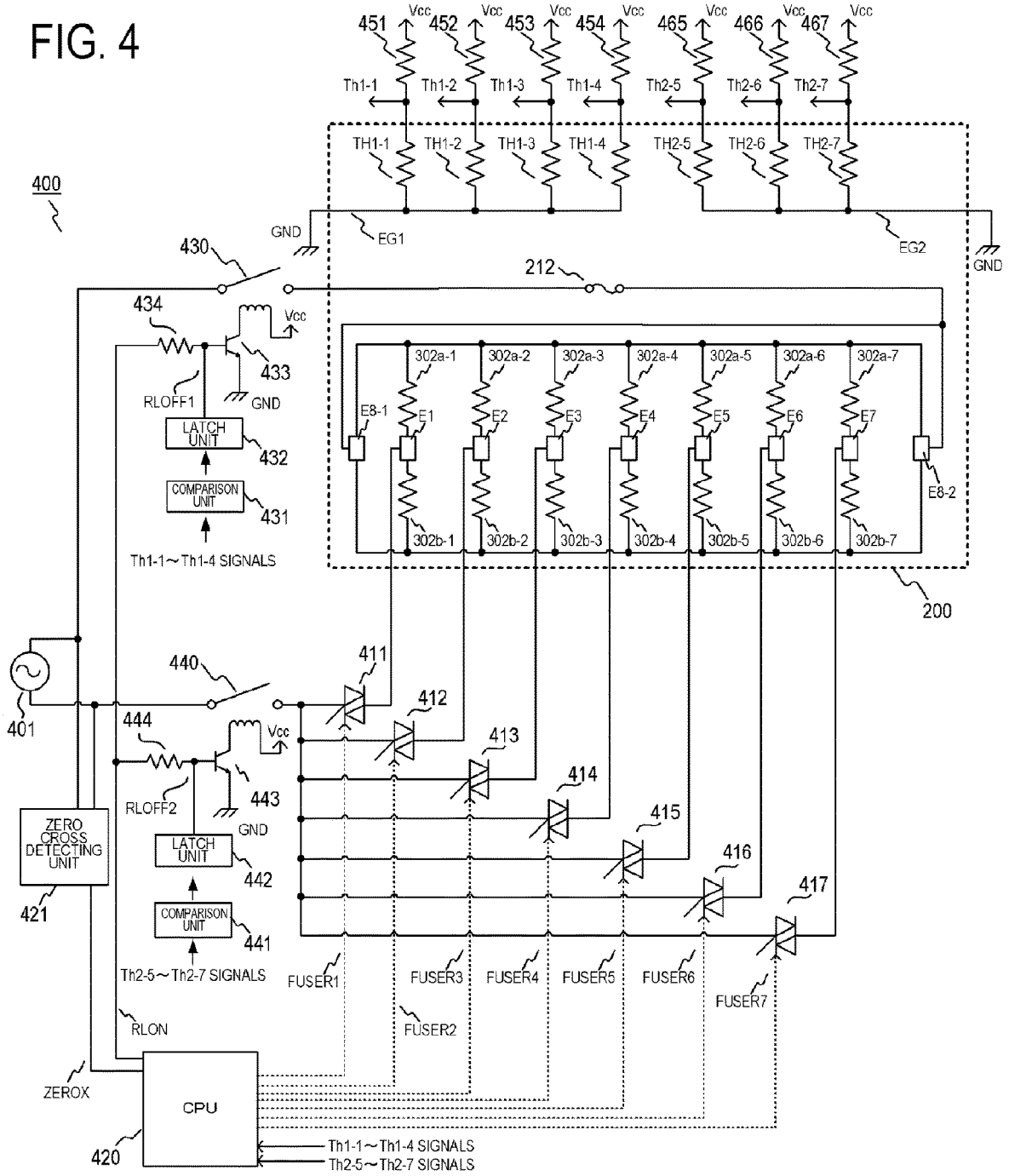
FIG. 4 is a heater control circuit diagram according to Example 1.

FIG. 4 is a circuit diagram of the control circuit 400 of the heater 300 of Example 1. 401 indicates a commercial AC power supply which is connected to the image forming apparatus 100. The power of the heater 300 is controlled by the ON/OFF of the triac 411 to triac 417. Each of the triacs 411 to 417 operates in accordance with FUSER1 to FUSER7 signals from the CPU 420. The driving circuits of the triacs 411 to 417 are omitted in FIG. 4. The control circuit 400 of the heater 300 is configured such that the seven heating blocks $HB_1$ to $HB_A$ can be independently controlled by the seven triacs 411 to 417. A zero cross detecting unit 421 is a circuit to detect the zero cross of the AC power supply 401, and outputs a ZEROX signal to the CPU 420. The ZEROX signal is used to detect the timings of the phase control and the wave number control of the triacs 411 to 417.

A temperature detection method of the heater 300 will be described. The temperature of the heater 300 is detected by the thermistors TH (TH1-1 to TH1-4, TH2-5 to TH2-7). Voltage divided between the thermistors TH1-1 to TH1-4 and resistors 451 to 454 are detected by the CPU 420 as Th1-1 to Th1-4 signals, and the CPU 420 converts the Th1-1 to Th1-4 signals into temperature values. In the same manner, the voltage divided between the thermistors TH2-5 to TH2-7 and resistors 465 to 467 are detected by the CPU 420 as the Th2-5 to Th2-7 signals, and the CPU 420 converts the Th2-5 to Th2-7 signals into temperature values.

In the internal processing of the CPU 420, power to be supplied to the heater 300 is calculated by proportional integral (PI) control based on the later mentioned control temperature (control target temperature) $TGT_i$ of each heating block, and the detected temperature of the thermistor. Further, the supply power is converted into a control level of a phase angle corresponding to the power (phase control) or to a control level of a wave number (wave number control), and the triacs 411 to 417 are controlled based on these control conditions. The CPU 420, which is a control portion and an acquiring portion of the present invention, executes various operations and energization control related to the temperature control of the heater 300.

A relay 430 and a relay 440 are used as a power interruption unit when the heater 300 overheats due to failure or the like. The circuit operation of the relay 430 and the relay 440 will be described. When an RLOW signal becomes High, a transistor 433 turns ON, power is supplied from a power supply voltage Vcc to a secondary side coil of the relay 430, and a primary side contact of the relay 430 turns ON. When the RLON signal becomes Low, the transistor 443 turns OFF, the current supplied from the power supply voltage Vcc to the secondary side coil of the relay 430 is interrupted, and the primary side contact of the relay 430 turns OFF. In the same manner, when the RLON signal becomes High, a transistor 433 turns ON, power is supplied from the power supply voltage Vcc to a secondary side coil of the relay 440, and a primary side contact of the relay 440 turns ON. When the RLON signal becomes Low, the transistor 443 turns OFF, the current supplied from the power supply voltage Vcc to the secondary side coil of the relay 440 is interrupted, and the primary side contact of the relay 440 turns OFF. The resistor 434 and the resistor 444 are current limiting resistors.

An operation of a safety circuit using the relay 430 and the relay 440 will be described. When any one of the temperatures detected by the thermistors TH1-1 to TH1-4 exceeds a respective predetermined set value, a comparison unit 431 activates a latch unit 432, and the latch unit 432 latches an RLOFF1 signal in the Low state. When the RLOFF1 signal becomes Low, the transistor 433 is kept in the OFF state, even if the CPU 420 sets the RLON signal to High, hence the relay 430 is maintained in the OFF state (safe state). Here, the latch unit 432 sets the RLOFF1 signal to open in the non-latch state. In the same manner, when any one of the temperatures detected by the thermistors TH2-5 to TH2-7 exceeds a respective predetermined set value, a comparison unit comparing portion 441 activates a latch unit 442, and the latch unit 442 latches an RLOFF2 signal in the Low state. When the RLOFF2 signal becomes Low, the transistor 443 is kept in the OFF state even if the CPU 420 sets the RLON signal to High, hence the relay 440 is maintained in the OFF state (safe state). The latch unit 442 also sets the RLOFF2 signal to open in the non-latch state.

5. Setting of Heating Region

Figure 5:
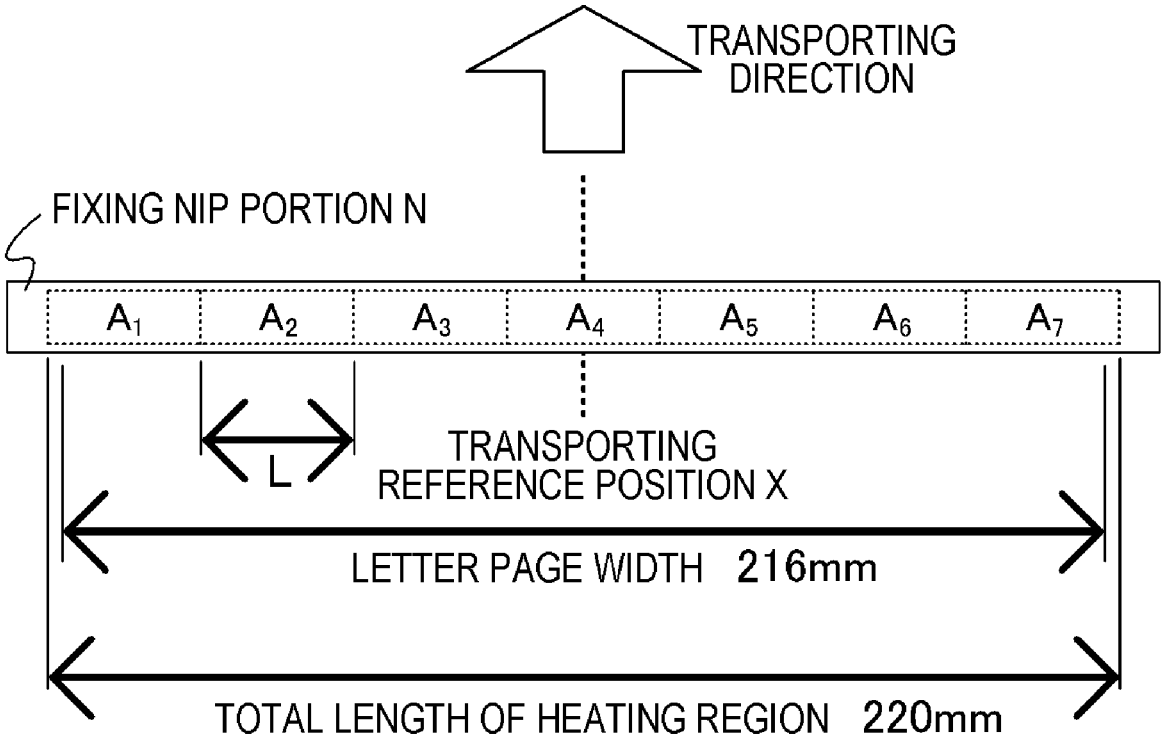
FIG. 5 is a diagram depicting heating regions according to Example 1.

FIG. 5 is a diagram depicting heating regions $A_1$ to $A_7$ according to Example 1, and is depicted in comparison with the paper width of the LETTER size paper. The heating regions $A_1$ to $A_7$ are disposed at the positions corresponding to the heating blocks $HB_1$ to $HB_7$ in the fixing nip portion N, and each of the heating regions $A_i$ (i=1 to 7) is heated by heating of the heating blocks $HB_i$ (i=1 to 7) respectively. The total length of the heating regions $A_1$ to $A_7$ is 220 mm, and each region is determined by equally dividing this length into seven (L=31.4 mm).

Figure 6A:
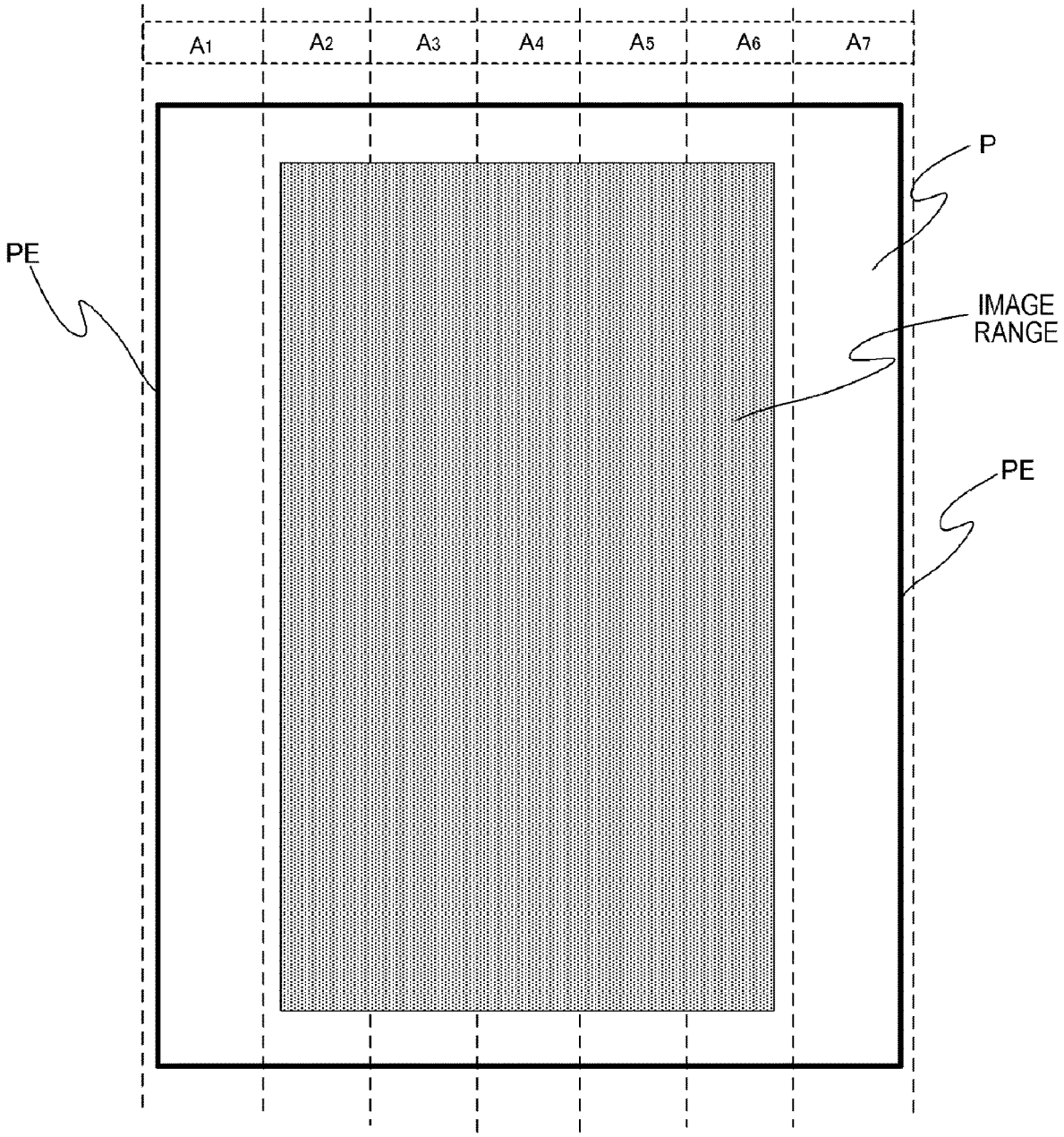

The classification of the heating region A will be described using concrete examples with reference to FIGS. 6A and 6B. The recording material P is letter size (hereafter LTR size) paper, and passes through a range from the heating region $A_1$ to the heating region $A_7$. In the heating region $A_1$ to the heating region $A_7$, the recording material P and the image exist in the positions illustrated in FIG. 6A. Here, both ends of the recording material P in the longer direction of the heater are indicated as PE. FIG. 6B indicates the classification of the heating region $A_i$. As indicated in the image data (image information), the heating regions $A_2$, $A_3$, $A_4$, $A_5$ and $A_6$ are classified as the image heating region AI, since the image range (range where the image on the recording material exists) passes through these heating regions. The heating regions $A_1$ to $A_7$, on the other hand, are regions where the image range does not pass through. In other words, the heating regions $A_1$ and $A_7$ are regions where only a non-image portion, in which an image is not formed on the recording material, passes through, hence the heating regions $A_1$ and $A_7$ are classified as the non-image heating region AP.

6. Overview of Heater Control Method

A heater control method according to Example 1, that is, a method of controlling an amount of heating in the heating blocks $HB_i$ (i=1 to 7) will be described next. The amount of heating of the heating block $HB_i$ is determined depending on the supply power to the heating block $HB_i$. By increasing the supply power to the heating block $HB_i$, the amount of heating of the heating block $HB_i$ increases, and by decreasing the supply power to the heating block $HB_i$, the amount of heating of the heating block $HB_i$ decreases. The supply power to the heating block $HB_i$ is calculated based on the control temperature $TGT_i$ (i=1 to 7) that is set for each heating block, and the detected temperature by the thermistor. In Example 1, the supply power is calculated by proportional integral (PI) control, so that the temperature detected by each thermistor becomes the same as the control temperature $TGT_i$ of each heating block.

Figure 7:
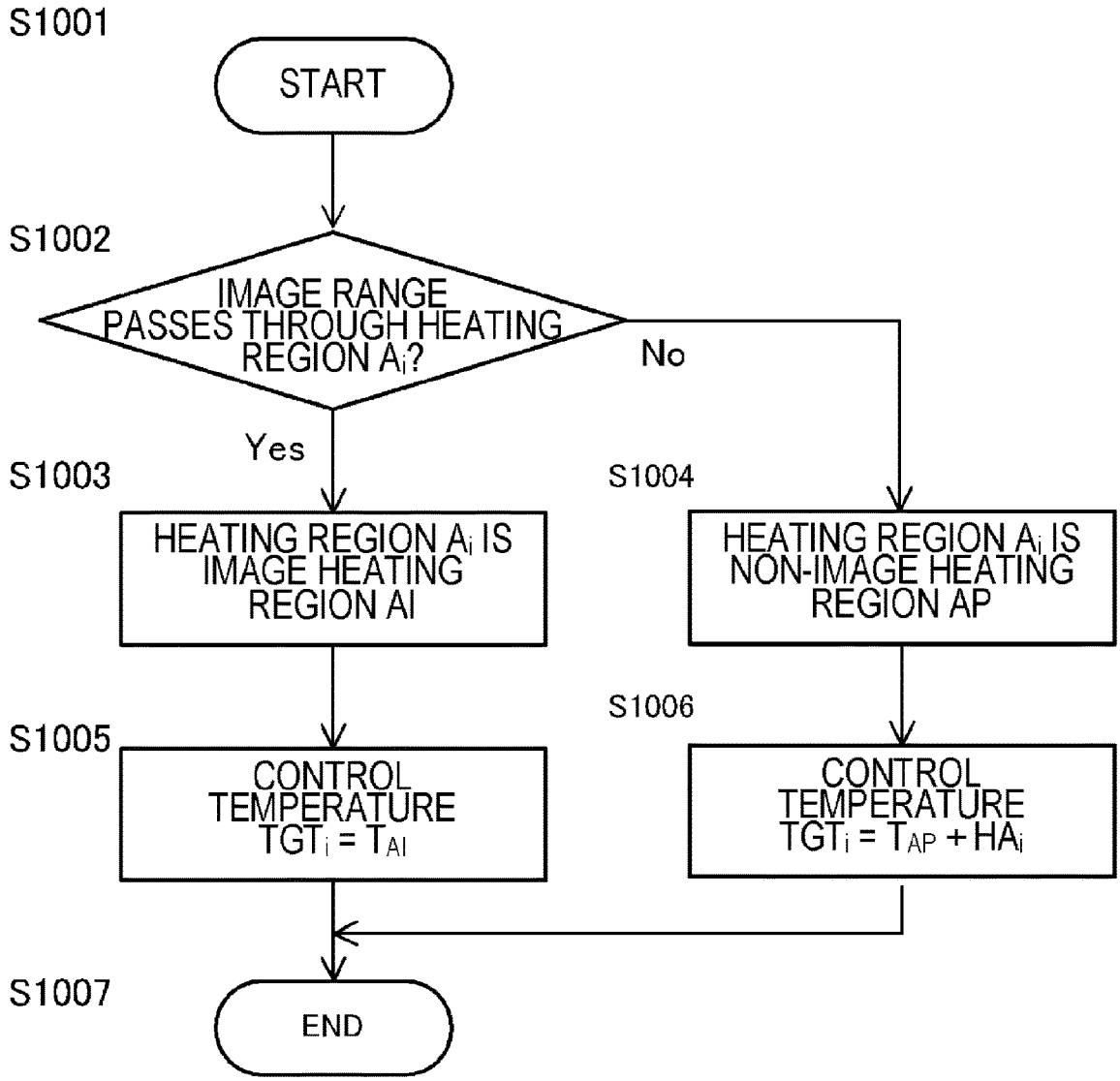
FIG. 7 is a flow chart to determine the classification of the heating region and the control temperature according to Example 1.

FIG. 7 is a flow chart to determine the classification of the heating region and the control temperature according to Example 1. As depicted in FIG. 7, each heating region $A_i$ (i=1 to 7) is classified as the image heating region AI or the non-image heating region AP. The heating region $A_i$ is classified based on the image data (image information) and the recording material information (recording material size) sent from an external device (not illustrated) such as a host computer.

It is determined whether the heating region $A_i$ is in the image range based on the image data (image information) (FIG. 7: S1002). If in the image range, the heating region $A_i$ is classified as the image heating region AI (FIG. 7: S1003), and if not, the heating region $A_i$ is classified as the non-image heating region AP (FIG. 7: S1004). If classified as the image heating region AI, the control temperature $TGT_i$ is set to $TGT_i=T_{AI}$ (FIG. 7: S1005). Here, $T_{AI}$ is a reference temperature of the image heating region (hereafter image portion reference temperature $T_{AI}$), and is set to an appropriate temperature to fix an unfixed image to the recording material P. The image portion reference temperature $T_{AI}$ is preferably adjustable depending on the type of the recording material P, such as basis weight and surface property of the recording material P, the image information, such as image density and pixel density, and the heat storage amount of the fixing apparatus 200. In Example 1, if the recording material P is plain paper, the image portion reference temperature $T_{AI}$ is 200° C.

A case where the heating region A is classified as the non-image heating region AP will be described next. If the heating region $A_i$ is classified as the non-image heating region AP, the control temperature $TGT_i$ is set to $TGT_i=T_{AP}+HA_i$ (FIG. 7: S1006). Here $T_{AP}$ indicates a reference temperature of the non-image heating region (hereafter non-image portion reference temperature $T_{AP}$), and $HA_i$ indicates a correction temperature. By setting the non-image portion reference temperature $T_{AP}$ to be lower than the image portion reference temperature $T_{AI}$, the amount of heating of the heating block $HB_i$ in the non-image heating region AP is decreased compared with the image heating region AI, so as to conserve power of the fixing apparatus 200. The non-image portion reference temperature $T_{AP}$ is preferably adjustable depending on the type of the recording material P (e.g. basis weight and surface property of recording material P) and the storage heat amount of the fixing apparatus 200. The non-image portion reference temperature $T_{AP}$ and the correction temperature HA will be described in detail in the next section.

7. Details on Heater Control Method

In this section, the non-image portion reference temperature $T_{AP}$ and the correction temperature $HA_i$, described in the previous section, will be described using concrete examples.

The non-image portion reference temperature $T_{AP}$ will be described first. In the case where the recording material P illustrated in FIG. 6A (LTR size: paper width 216 mm; paper length 279 mm, basis weight 75 g/m$^2$) is fed, the heating regions $A_2$ to $A_6$ are determined as the image heating region AI, and the heating regions $A_1$ and $A_7$ are determined as the non-image heating region AP, as indicated in FIG. 6B.

Figure 8A:
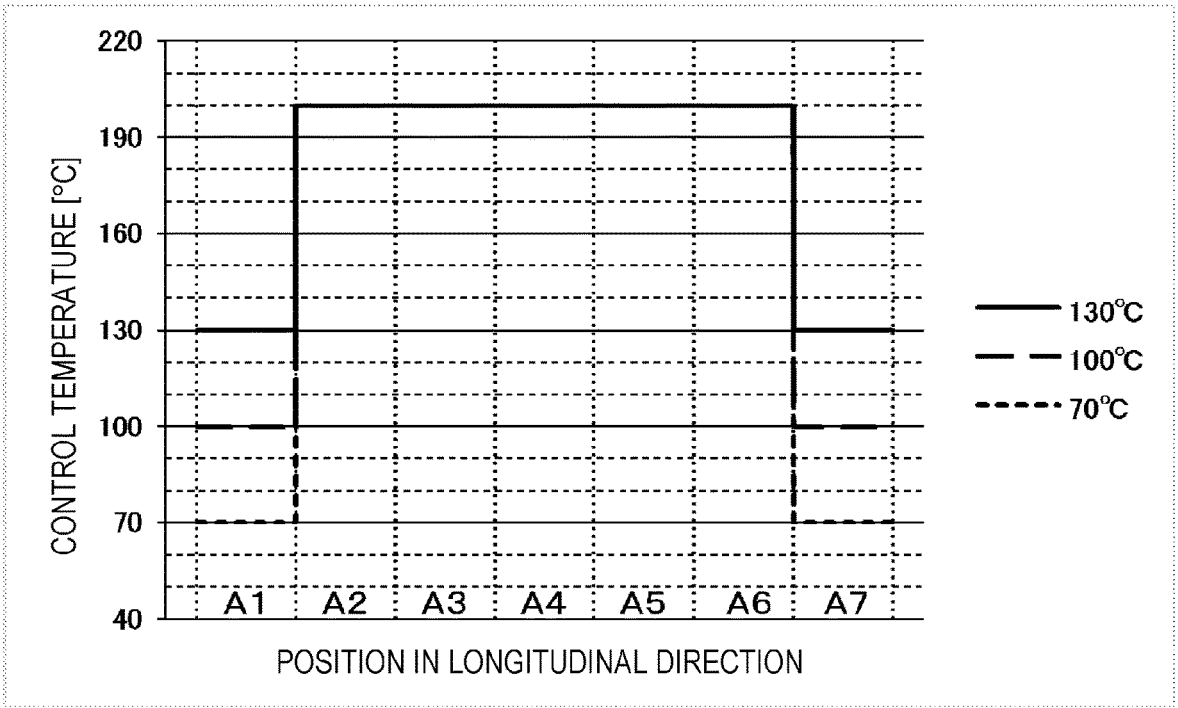
FIGS. 8A and 8B indicate graphs to describe the set values of the control temperature according to Example 1.
Figure 8B:
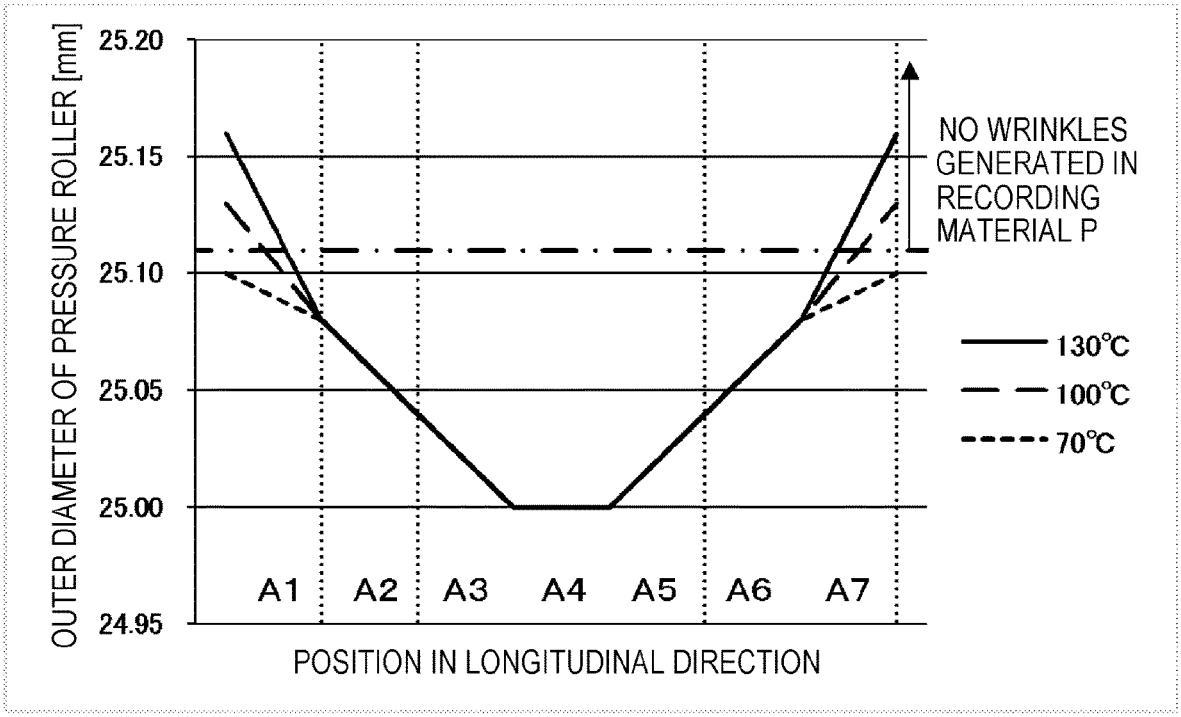

FIG. 8A indicates the control temperature of each heating region, and FIG. 8B indicates the outer diameter of the pressure roller 208. In FIGS. 8A and 8B, the differences when the control temperatures $TGT_1$ and $TGT_7$ of the heating regions $A_1$ and $A_7$ are set to 130° C. (solid line), 100° C. (long broken line) and 70° C. (short broken line) are depicted. The heating regions $A_2$ to $A_6$ are the image heating regions AI, hence the control temperature $TGT_i$ thereof is set to 200° C., as mentioned in the previous section. The heating regions $A_1$ and $A_7$ are non-image heating regions AP, and the power consumption of the fixing apparatus 200 decreases as the control temperature $TGT_i$ thereof is lower. However, in this case, the outer diameter of the ends of the pressure roller 208 become small, and the inverted crown amount of the pressure roller 208 becomes small accordingly, therefore the effect of suppressing the wrinkles in the recording material P is diminished.

On the other hand, as the control temperature $TGT_i$ of the heating regions $A_1$ and $A_7$ is higher, the outer diameter of the ends of the pressure roller 208 increases, and the inverted crown amount of the pressure roller 208 also increases, hence the effect of suppressing wrinkles in the recording material P increases. However, power consumption of the fixing apparatus 200 increases.

In the configuration of Example 1, wrinkles are generated in the recording material P if the inverted crown amount of the pressure roller 208 is less than 110 (dashed line in FIGS. 8A and 8B) according to experiments. In other words, in order to prevent generation of wrinkles in the recording material P, at least a 110 μm inverted crown amount must be ensured in the case of Example 1. As indicated in FIG. 8B, if the control temperature of the non-image portion is 70° C., the inverted crown amount of the pressure roller 208 is 100 μm, and wrinkles are generated in the recording material P. If the control temperature of the non-image portion is 100° C., the inverted crown amount of the pressure roller 208 becomes 130 μm, and wrinkles are not generated in the recording material P. If the control temperature of the non-image portion is 130° C., the inverted crown amount of the pressure roller 208 becomes 160 μm, and wrinkles are not generated in the recording material. However, power consumption of the fixing apparatus 200 increases compared with the case when the control temperature of the non-image portion is 100° C.

Therefore in Example 1, considering suppression of wrinkles in the recording material and conserving power of the fixing apparatus 200, the non-image portion reference temperature $T_{AP}$ is set to 100° C. as a temperature at which a minimum inverted crown amount, that is required to prevent generation of wrinkles in the recording material P, can be maintained. By setting the non-image portion reference temperature $T_{AP}$ to a temperature that is 100° C. lower than the image portion reference temperature $T_{AP}$, the inverted crown amount of the pressure roller 208 becomes at least 110 μm, hence generation of wrinkles in the recording material P can be suppressed while conserving power of the fixing apparatus 200.

Figure 9A:
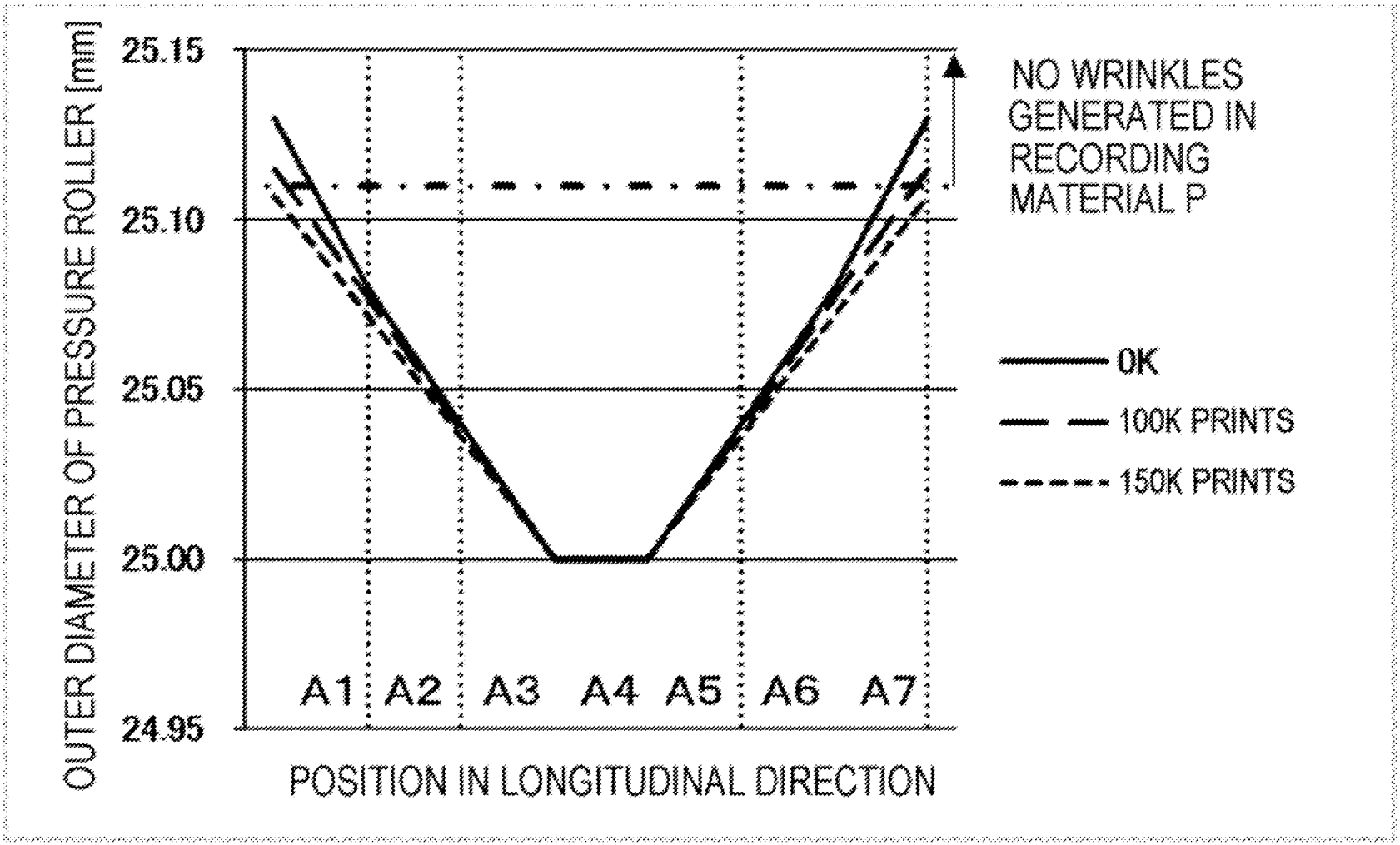
FIGS. 9A and 9B indicate graphs depicting a change in the outer diameter of the pressure roller with respect to a cumulative sum of number of prints according to Example 1.

A correction temperature $HA_i$, which is a correction amount reflecting the amount of the fixing apparatus 200 used, will be described next. In the fixing apparatus 200, the inverted crown amount of the pressure roller 208 gradually decreases as the cumulative sum of number of prints (cumulative sum of number of recording materials of which image is heated) increases, and the effect of suppressing generation of wrinkles in the recording material P is diminished accordingly. Therefore it is necessary to predict the change in the inverted crown amount of the pressure roller 208 caused by the increase of a cumulative sum of number of prints, and to increase the control temperature of the non-image heating region until entering the range where the wrinkles are not generated in the recording material P. For this, if the heating region $A_i$ is classified as the non-image heating region AP, the control temperature $TGT_i$ is set to $TGT_i=T_{AP}+HA_i$ (FIG. 7: S1006), and the correction temperature HA is set in accordance with the cumulative sum of number of prints. Then the generation of wrinkles in the recording material P can be suppressed, regardless the cumulative sum of number of prints. FIG. 9A indicates the changes of the cumulative sum of number of prints of the recording material P and the outer diameter of the pressure roller 208, when the control temperature of the non-image heating region is 100° C. FIG. 9A indicates the differences when the cumulative sum of number of prints is set to 0K (solid line), 100K (long broken line) and 150K (short broken line). When the cumulative sum of number of prints is 0K, the inverted crown amount of the pressure roller 208 is 130 μm, and wrinkles are not generated in the recording material P. However, as the cumulative sum of number of prints increases, the inverted crown amount of the pressure roller 208 gradually decreases. When the number of prints exceeds 100K, the inverted crown amount is 115 μm, and wrinkles are not generated in the recording material P. When the number of prints exceeds 150K, the inverted crown amount is 107 μm, which is less than 110 μm (dashed line in FIGS. 9A and 9B), hence wrinkles are generated in the recording material P. Therefore the correction temperature HA is set in accordance with the change in the outer diameter of the pressure roller 208, that is, the change of the inverted crown amount caused by the increase in the cumulative sum of number of prints.

Figure 9B:
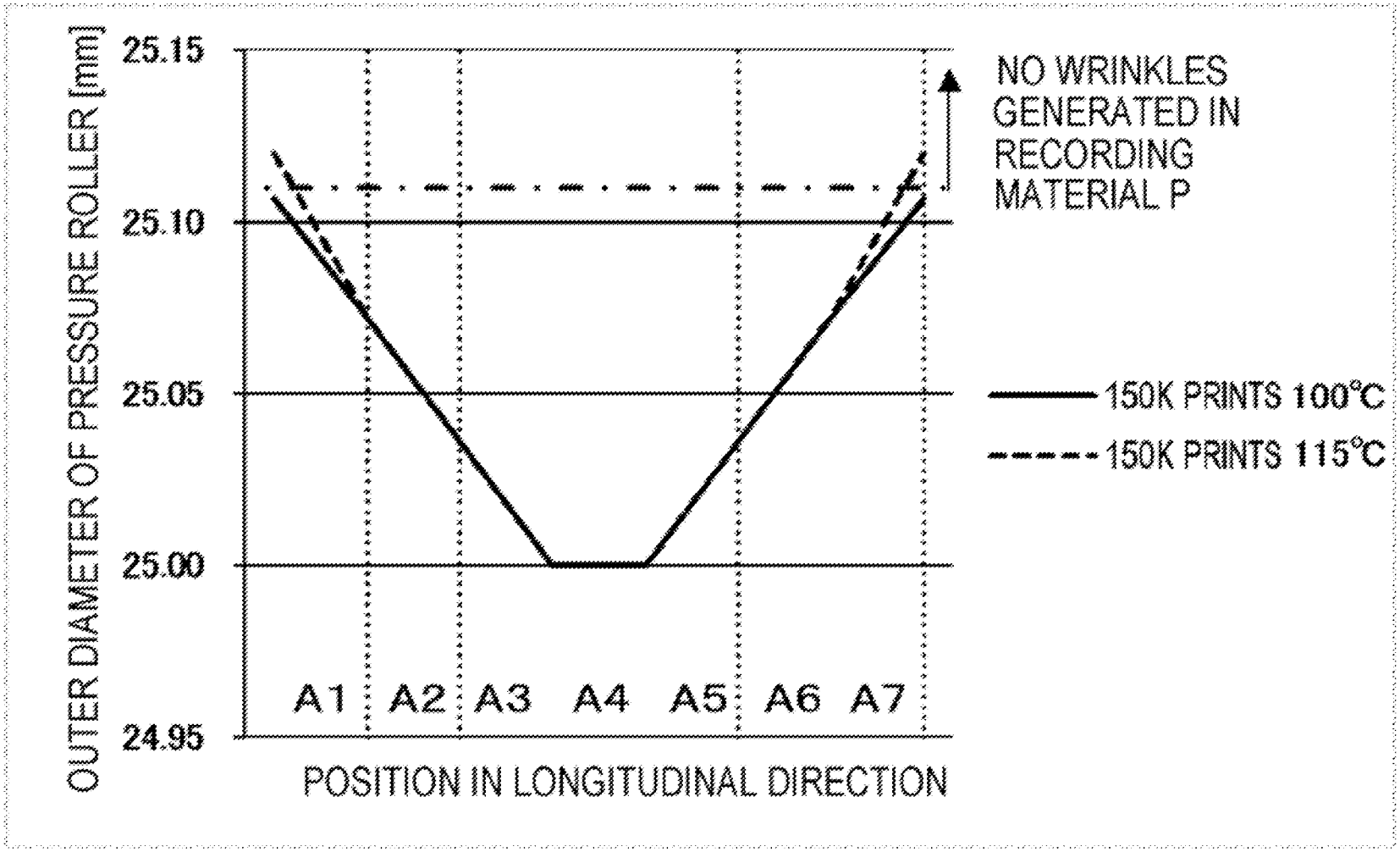
Figure 10A:
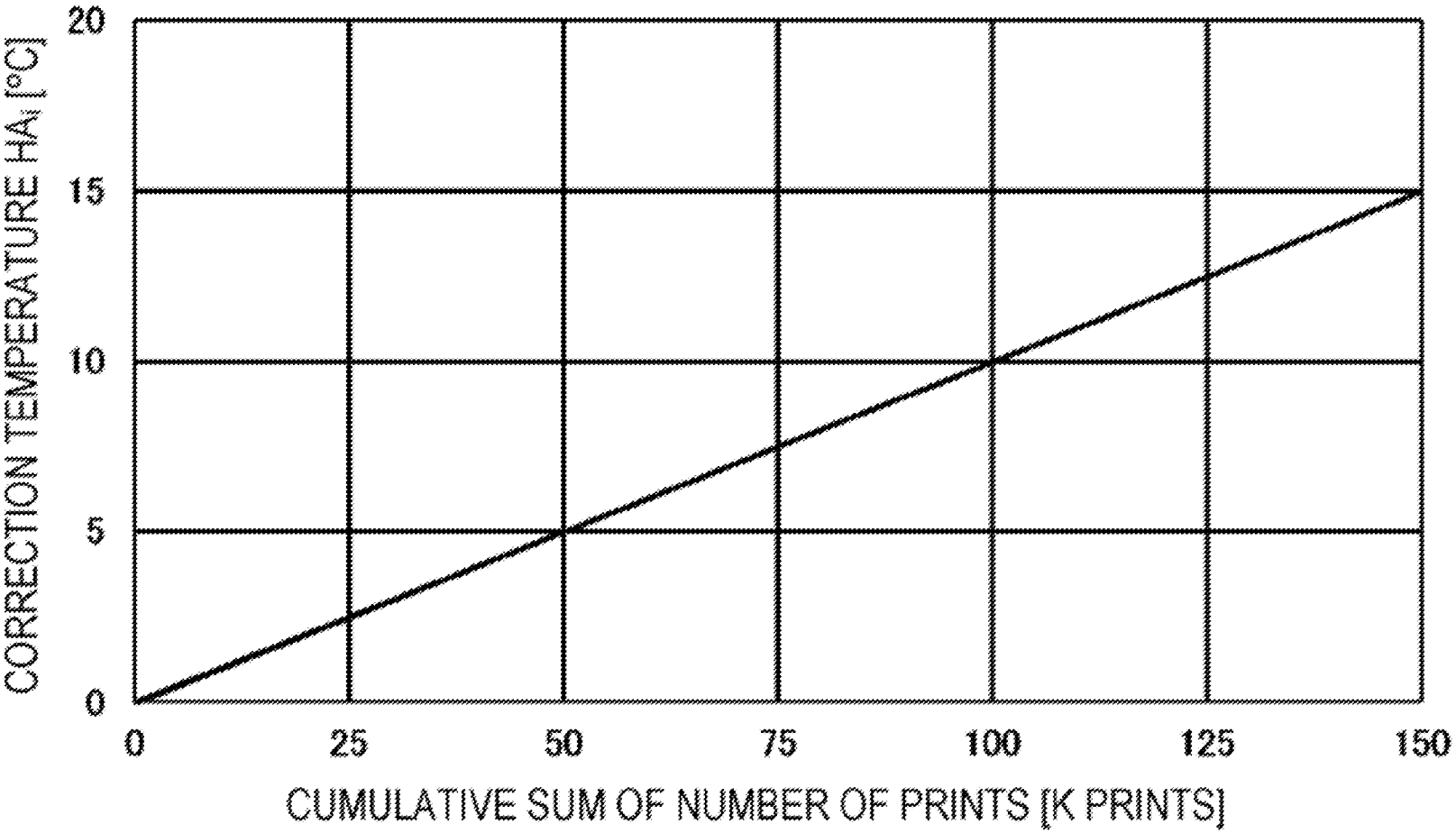
FIGS. 10A and 10B indicate graphs to describe the set values of the correction temperature according to Example 1.

FIG. 10A indicates a relationship between the cumulative sum of number of prints and the correction temperature $HA_i$ according to Example 1. As indicated in FIG. 10A, the correction temperature $HA_i$ is set to 0° C. when the cumulative sum of number of prints is 0K, and to 15° C. when the cumulative sum of number of prints is 150K. Then the control temperature in the non-image heating region ($TGT_1$, $TGT_7$) is 100° C. when the cumulative sum of number of prints is 0K, and is 115° C. when the cumulative sum of number of prints is 150K. FIG. 9B indicates the outer diameter of the pressure roller 208, of which the cumulative sum of number of prints is 150K, when the control temperature in the non-image heating region ($TGT_1$, $TGT_7$), is 100° C. and 115° C. As indicated in FIG. 9B, if the control temperature in the non-image heating region ($TGT_1$, $TGT_7$) is increased by adding the correction temperature HA when the cumulative sum of number of prints is 150K, the inverted crown amount of the pressure roller 208 becomes 120 μm. This means that the inverted crown amount is 110 μm or more, hence generation of wrinkles in the recording material P can be suppressed. Even when the cumulative sum of number of prints is 150K, the control temperature in the non-image heating region ($TGT_1$, $TGT_7$) is set to a temperature that is 85° C. lower than the control temperature in the image heating region ($TGT_2$ to $TGT_6$). The designed lifespan of the fixing apparatus 200 of Example 1 is 100K prints. In the fixing apparatus 200 of Example 1, generation of wrinkles in the recording material P can be suppressed even if the cumulative sum of number of prints exceeds 50K from the designed lifespan of 100K, hence the lifespan of the fixing apparatus 200 can be extended by 50K. As a consequence, using the configuration of Example 1 can implement both conserving power and longer lifespan of the fixing apparatus 200.

Figure 10B:
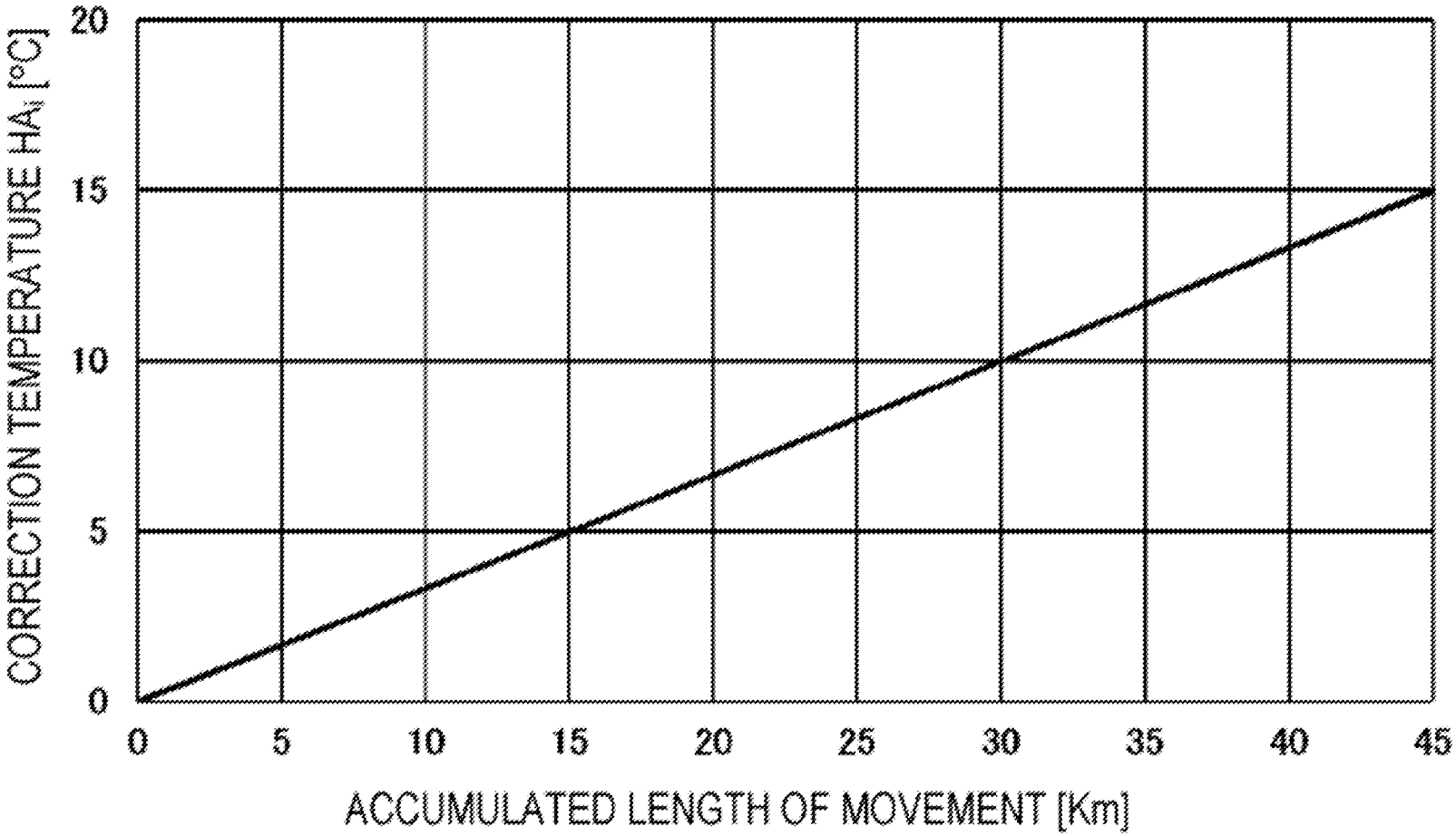

In Example 1, as mentioned above, the inverted crown amount must be predicted in order to set the control temperature of the non-image heating region to an appropriate range. The inverted crown amount of the pressure roller 208 may be predicted by a method other than a number of prints. For example, as indicated in FIG. 10B, the inverted crown amount of the pressure roller 208 may be predicted from the accumulated length of movement of the fixing apparatus 200, whereby the correction temperature $HA_i$ is set thereby. Further, the correction temperature $HA_i$ may be corrected using the information on the operating environment (ambient temperature, ambient humidity) and information on the recording material P (basis weight, surface property).

An application example of Example 1 will be described with reference to FIGS. 11A and 11B. This application example is a control example when the recording material P indicated in FIG. 11A (LTR size: paper width 216 mm; paper length 279 mm; basis weight 75 g/m$^2$) is fed. In this application example, the heating region $A_4$ is determined as the image heating region AI, and the heating regions other than the heating region $A_4$ are determined as the non-image heating regions AP, as indicated in FIG. 11B based on the image information.

Figure 12:
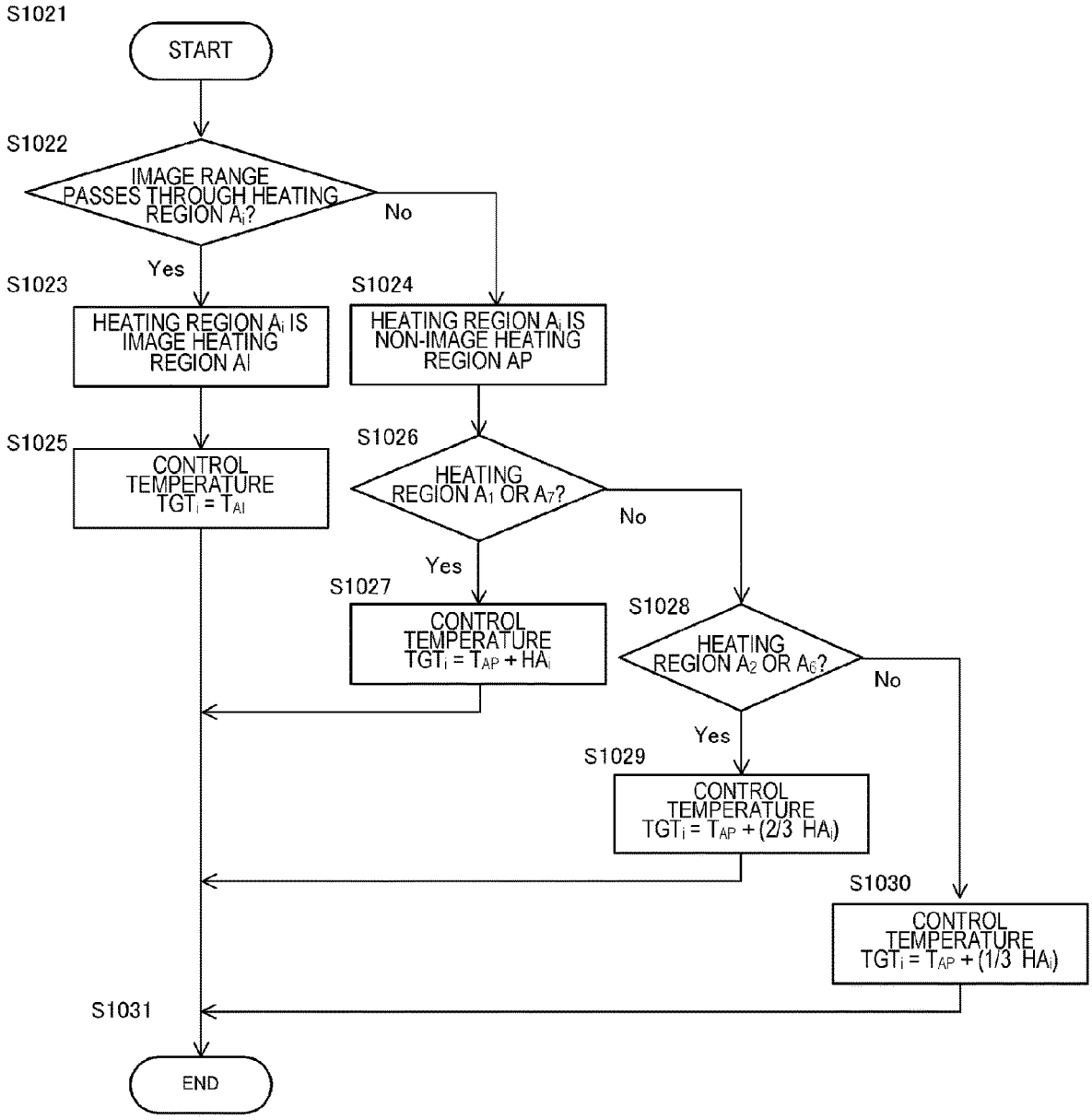
FIG. 12 is a flow chart to determine the classification of the heating region and the control temperature according to an application example of Example 1.

FIG. 12 indicates a sequence to determine the classification of the heating region and the control temperature according to this application example. As depicted in FIG. 12, when the non-image heating region AP is the heating region $A_2$ or the heating region $A_6$, the control temperature is set to $TGT_i=T_{AP}+(2/3\times HA_i)$ (FIG. 12: S1029). When the non-image heating region AP is the heating regions $A_3$ to $A_5$, the control temperature is set to $TGT_i=T_{AP}+(1/3\times HA_i)$ (FIG. 12: S1030). In other words, the control temperature is set such that the correction temperature HA increases from the center portion to the ends in the longer direction.

Figure 11A:
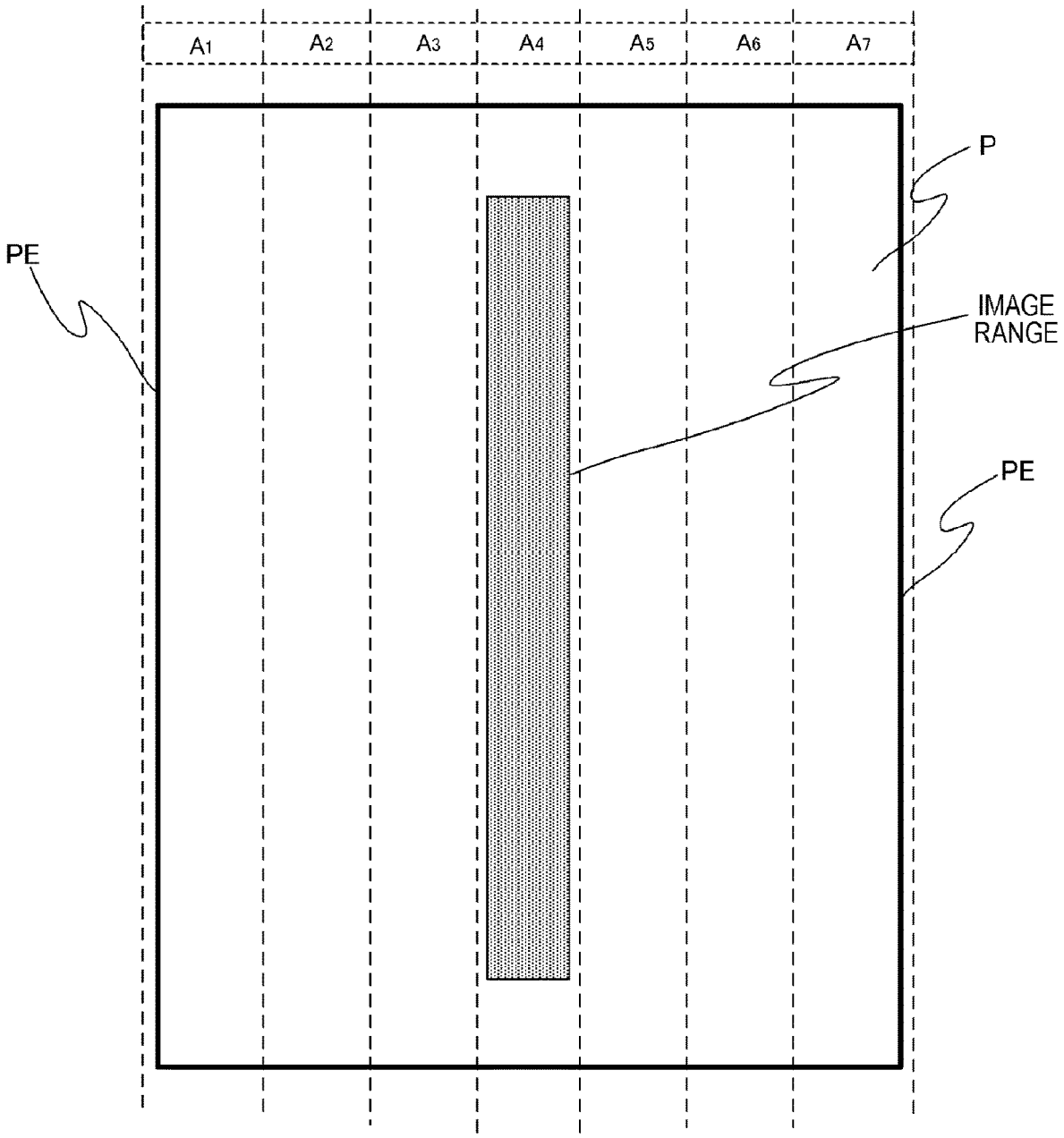
Figure 13:
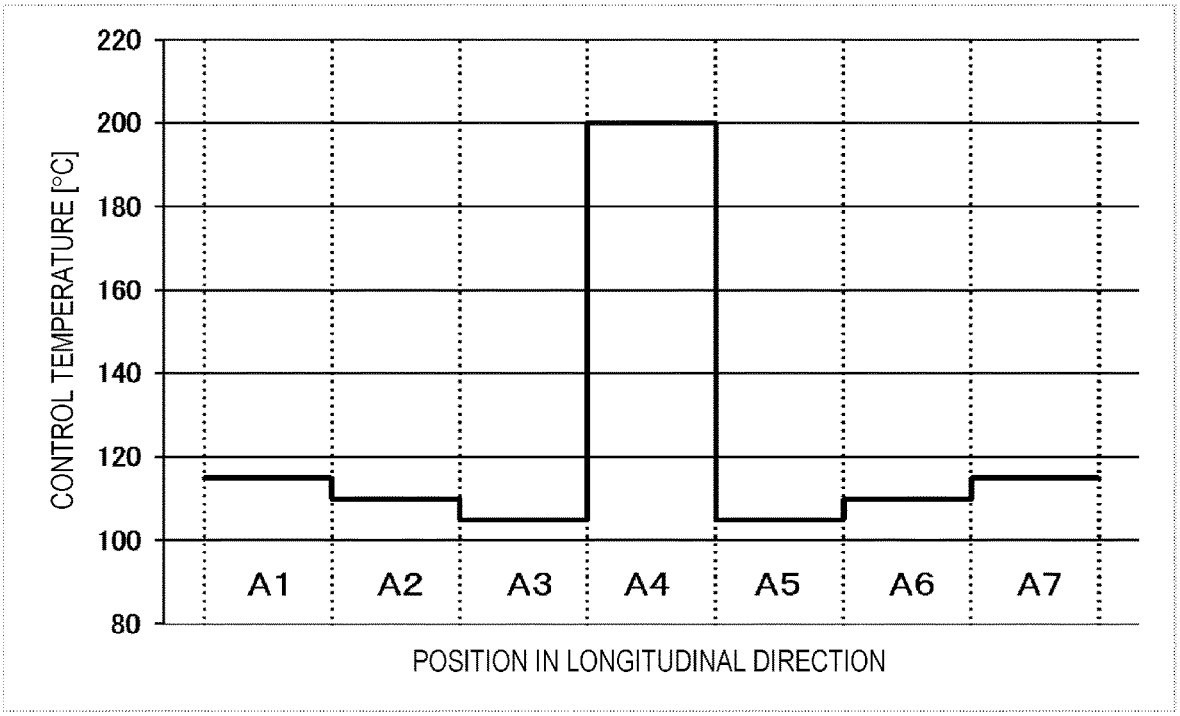
FIG. 13 is a graph to describe the set values of the control temperature according to an application example of Example 1.

As an example of the control temperature of this application example, FIG. 13 indicates a control temperature of each heating region when the recording material P in FIGS. 11A and 11B is printed by the fixing apparatus 200, in which cumulative sum of number of prints is 150K. According to the sequence in FIG. 12, the control temperatures $TGT_1$ and $TGT_7$ in the heating regions $A_1$ and $A_7$ (heating blocks $HB_1$ and $HB_7$ corresponding to $A_1$ and $A_7$) are 115° C., the control temperatures $TGT_2$ and $TGT_6$ in the heating regions $A_2$ and $A_6$ (heating blocks $HB_2$ and $HB_6$ corresponding to $A_2$ and $A_6$) are 110° C., and the control temperatures $TGT_3$ and $TGT_5$ in the heating regions $A_3$ and $A_5$ (heating blocks $HB_3$ and $HB_5$ corresponding to $A_3$ and $A_5$) are 105° C. In other words, the control temperature of the non-image heating region is set so as to be increased in steps, from the center portion to the ends in the longer direction. Thereby the control temperatures in the non-image heating regions ($A_2$, $A_3$, $A_5$ and $A_6$) at the center portion in the longer direction can be set low, while suppressing generation of wrinkles in the recording material P, and power consumption of the fixing apparatus 200 can be decreased. As indicated in the application example, if the configuration of Example 1 is used, the correction temperature with respect to the control temperature of the non-image heating region AP can be precisely set in accordance with the size and image information of the recording material P, hence both conserving power and longer lifespan of the fixing apparatus 200 can be implemented.

Figure 14:
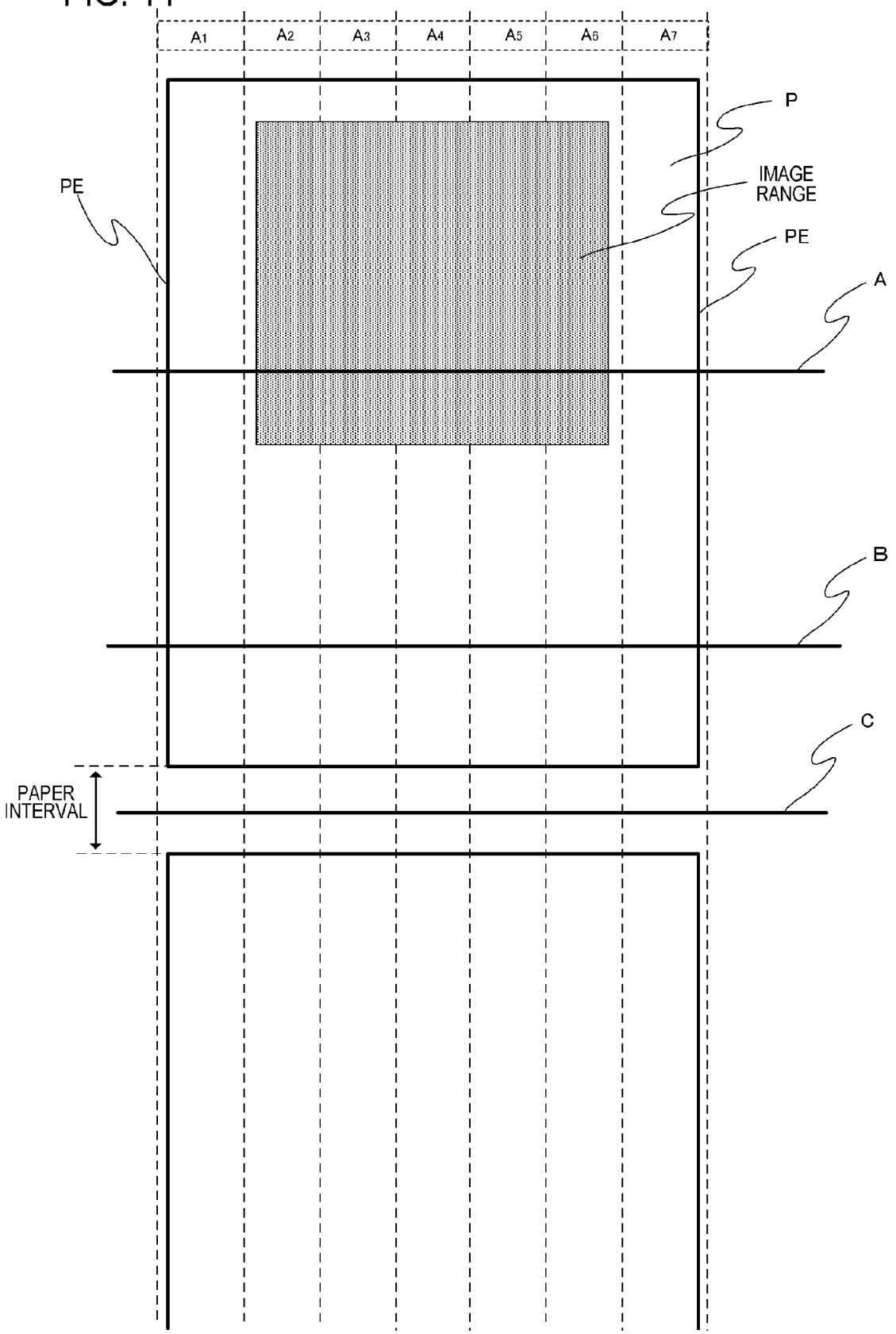
FIG. 14 is a diagram depicting a concrete example of the classification of the heating region according to an application example of Example 1.
Figure 15:
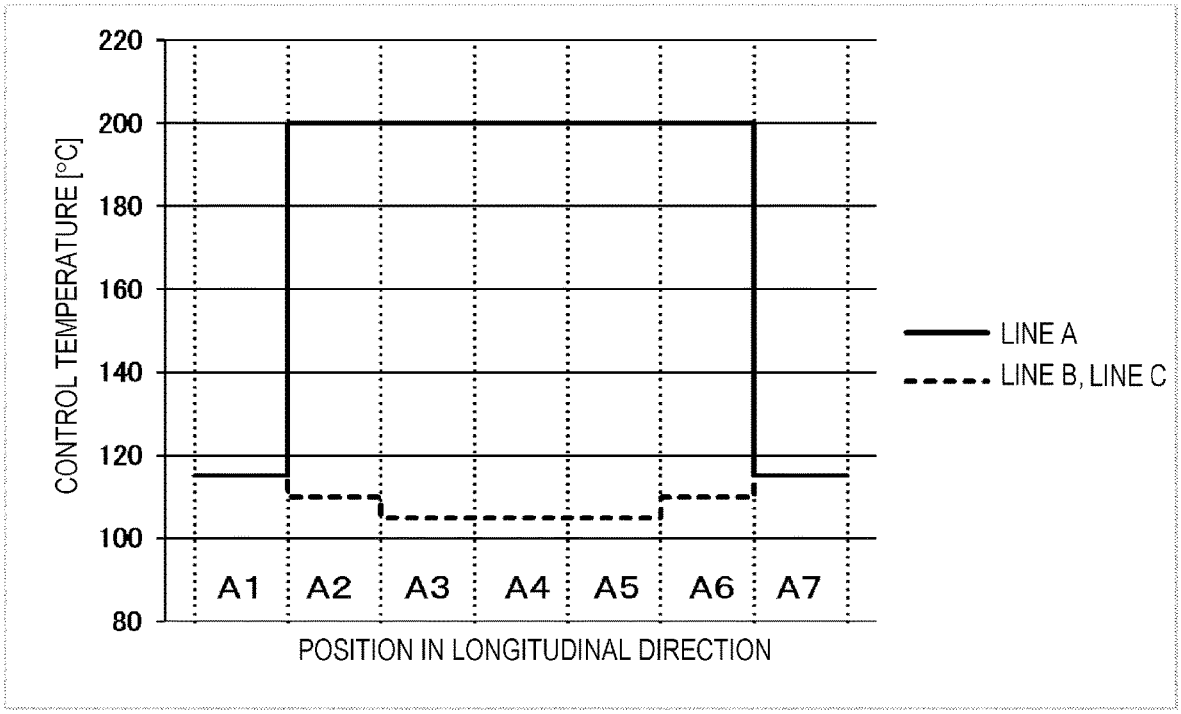
FIG. 15 is a graph to describe the set values of the control temperature according to an application example of Example 1.

The control of this application example may be used for paper interval control and temperature control of the non-image region. For example, in the case of feeding the recording material P in FIG. 14, the line A indicates the image region in the recording material P, the line B indicates the non-image region in the recoding material P, and the line C indicates the position of a region between paper, and FIG. 15 indicates the control temperature in each heating region at the positions of the line A to the line C. At the position of the line A, the control temperature in each heating region cannot be freely set, since the control temperature at the center portion in the longer direction must be set high in order to fix the image region at the center portion in the longer direction. At the positions of the line B and the line C, on the other hand, the control temperature in each heating region can be freely set since there is no image region, and it is not necessary to be concerned with fixability. As indicated in FIG. 15, the control temperature in each heating region is set low at the positions of the line B and the line C, since there is no image region, and the control temperature is gradually increased from the center portion to the ends in the longer direction. Therefore the power consumption can be decreased by setting the control temperature low, and form of the outer diameter of the pressure roller 208 can be an inverted crown shape, whereby generation of wrinkles in the recording material P can be suppressed. Since the correction temperature with respect to the control temperature of the non-image heating region AP can be precisely set, as mentioned above, in the non-image region and region between paper, both conserving power and longer lifespan of the fixing apparatus 200 can be implemented.

The pressure roller 208 has an inverted crown shape, and the outer diameters at both ends are larger than the center portion in the longer direction, which means that the stress applied to the pressure roller 208 by the pressing force is larger at both ends than at the center portion in the longer direction. Therefore at both ends of the pressure roller 208 in the longer direction, the outer diameter changes more easily and the inverted crown amount decreases more, compared with the center portion in the longer direction. Therefore the correction temperature HA in the heating regions $A_1$ and $A_7$, which are both ends of the pressure roller 208 in the longer direction, may be set to a higher temperature compared with the correction temperature in the other heating regions. If the heating regions $A_1$ and $A_7$ are non-image heating regions, the control temperature is set to $TGT_{1or7}=T_{AP}+HA_i\times 1.2$, for example. Thereby the correction temperature in the heating regions $A_1$ and $A_7$ can be increased, and the inverted crown amount of the pressure roller 208 can be set to a desired range.

8. Effect of Invention

The effect of the present invention will be described using the following concrete example. An experiment using comparative examples was performed to compare with the configuration of Example 1, so as to confirm the effect of Example 1. The comparative experiment will be described.

Using the fixing apparatus 200, 150K pages of recording material P (LTR size: paper width 216 mm, paper length 279 mm, basis weight 75 g/m$^2$) were printed, that is, the cumulative sum of number of prints of the fixing apparatus 200 is 150K. Then 10 pages of the recording material P (LTR size: paper width 216 mm, paper length 279 mm, basis weight 75 g/m$^2$) illustrated in FIGS. 6A and 6B were printed, and the frequency of generation of wrinkles in the recording material P in this case was compared between the configuration of Example 1 and the configuration of comparative examples.

According to the flow chart in FIG. 7, in the case of the configuration in Example 1, the heating regions $A_1$ and $A_7$ were determined as the non-image heating regions AP (FIG. 7: S1004), and the control temperature $TGT_i$ was set to $TGT_i=T_{AP}+HA_i$ (FIG. 7: S1006). The heating regions $A_2$ to $A_6$ were determined as the image heating regions AI (FIG. 7: S1003), and the control temperature $TGT_i$ was set to $TGT_i=T_{AI}$ (FIG. 7: S1005).

In the case of the configuration of Comparative Example 1, on the other hand, the correction temperature HA was not added, and the control temperatures in $A_1$ and $A_7$ were set to $TGT_i=T_{AP}$. The control temperatures in the heating regions $A_2$ to $A_6$ were set to $TGT_i=T_{AI}$, just like the configuration of Example 1. In the case of Comparative Example 2, the control temperatures in the heating regions $A_1$ and $A_7$, which are the non-image heating regions, were all set to $TGT_i=T_{AI}$, regardless whether an image existed in each heating region or not.

Table 1 indicates the result of this comparative experiment. As indicated in Table 1, in the configuration of Comparative Example 1, some wrinkles were generated in 5 out of 10 prints of the recording material P. In the case of the configuration of Example 1, on the other hand, no wrinkles were generated in the recording material P. In the configuration of Example 1, the correction temperature HA is added to the control temperatures of the heating regions $A_1$ and $A_7$. This increased the control temperatures in the heating regions $A_1$ and $A_7$, whereby the force to stretch the recording material P was applied in the direction from the center portion to the ends PE, and generation of wrinkles in the recording material P was suppressed. Even if the cumulative sum of number of prints increases 50K more than 100K, which is the designed lifespan, the fixing apparatus 200 of Example 1 can suppress generation of wrinkles in the recording material P. In other words, the lifespan of the fixing apparatus 200 can be extended by 50K if the configuration of Example 1 is used. In the case of the configuration of Comparative Example 2, no wrinkles were generated in the recording material P, but the average power consumed during printing is 770 W, which is 70 W more than Example 1. This is because the control temperature of the heating regions $A_1$ and $A_7$ are lower in Example 1 than in Comparative Example 2, that is, power consumption during printing is lower in Example 1. By the above comparative experiments, it was confirmed that the configuration of Example 1 can suppress generation of wrinkles in the recording material P, and can implement both conserving power and a longer lifespan.

TABLE 1

| | Wrinkle generation frequency in recording material P | Average power consumption during printing [W] |
|---|---|---|
| Example 1 | 0/10 | 710 |
| Comparative Example 1 | 5/10 | 700 |
| Comparative Example 2 | 0/10 | 770 |

Example 2

Example 2 of the present invention will be described. Example 2 is a configuration of using information of the thermal history of the heating region A, so that the accuracy of predicting the inverted crown amount of the pressure roller 208 is increased, and generation of wrinkles in the recording material P is further suppressed. The basic configurations of the image forming apparatus 100 and the fixing apparatus 200 of Example 2 are the same as Example 1. Therefore relevant issues not especially described in Example 2 are the same as Example 1.

In Example 1, the correction temperature $HA_i$ is set in accordance with the cumulative sum of number of prints or the accumulated length of movement of the image heating apparatus. However, in the case of the configuration of Example 1, the predicted value of the inverted crown amount of the pressure roller 208 may deviate in some cases. For example, as the control temperature $TGT_i$ in the heating region $A_i$ is higher, thermal deterioration of the pressure roller 208 becomes more pronounced, hence the inverted crown amount decreases even more.

Therefore in Example 2, the correction temperature $HA_i$ is set in accordance with the thermal history count value $HC_i$ of the heating region $A_i$. The thermal history count value $HC_i$ is a value representing the thermal history of the heating region $A_i$. The thermal history count value $HC_i$ is calculated by counting the thermal history of the heating region A based on such information as the control temperature, the heating time, the energization ratio and the amount of power. In Example 2, the thermal history count value $HC_i$ is calculated by the following expression.

$$HC_i=TGT_i\times t_{heat} \quad \text{(Expression 1)}$$

Here, $t_{heat}$ denotes the time during which heating is controlled with the control temperature $TGT_i$. In Example 2, using Expression 1, the thermal history count value $HC_i$ is calculated by multiplying the temperature difference between the control temperature and the reference temperature in the heating region A by the time during which heating control is performed. A greater value is set for the thermal history count value $HC_i$ as the control temperature in the heating region A is higher, or as the time during which the heating control is performed is longer.

Figure 16:
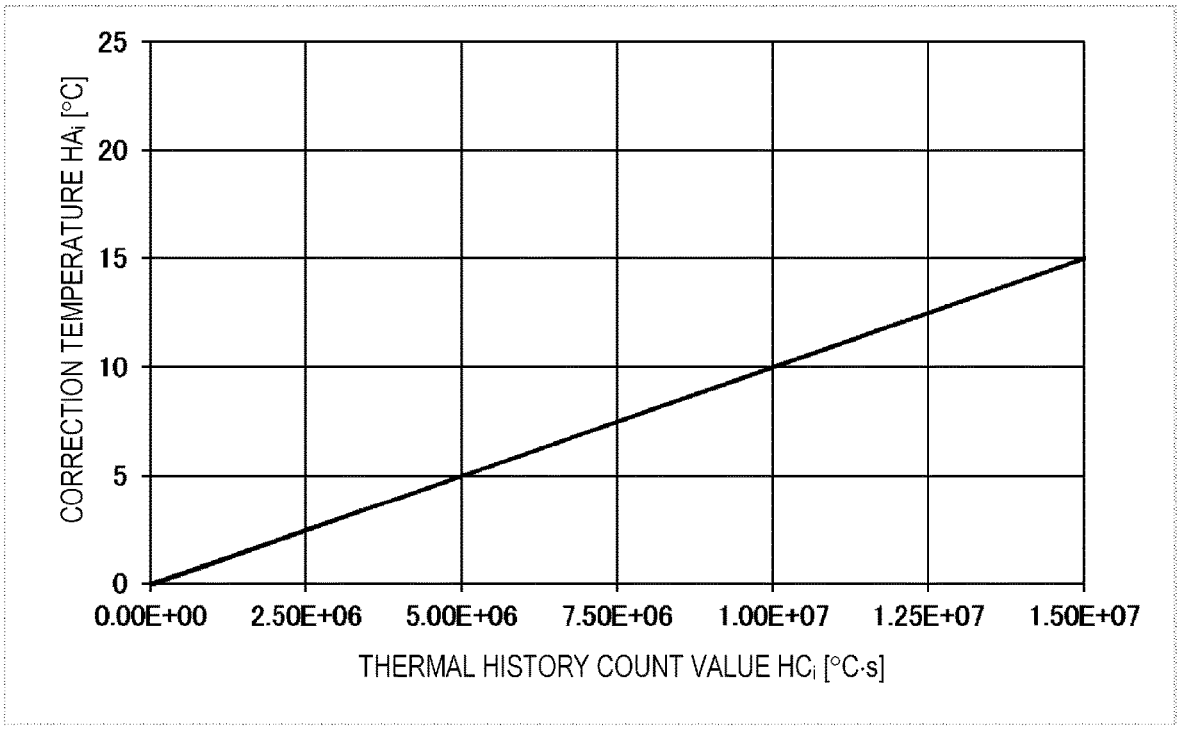
FIG. 16 is a graph to describe the set values of the correction temperature according to Example 2.

The correction temperature HA is set in accordance with the above mentioned thermal history count value $HC_i$. FIG. 16 indicates the relationship between the thermal history count value $HC_i$ and the correction temperature HA according to Example 2. As the thermal history count value $HC_i$ is greater, thermal deterioration of the pressure roller 208 becomes more pronounced, hence the inverted crown amount of the pressure roller 208 also decreases even more. Since the thermal history count value $HC_i$ correlates with the decrease in the inverted crown amount of the pressure roller 208 in this way, the correction temperature HA is set higher as the thermal history count value $HC_i$ is greater.

As an application example of Example 2, a case of feeding 150K of recording materials P illustrated in FIG.

Figure 17A:
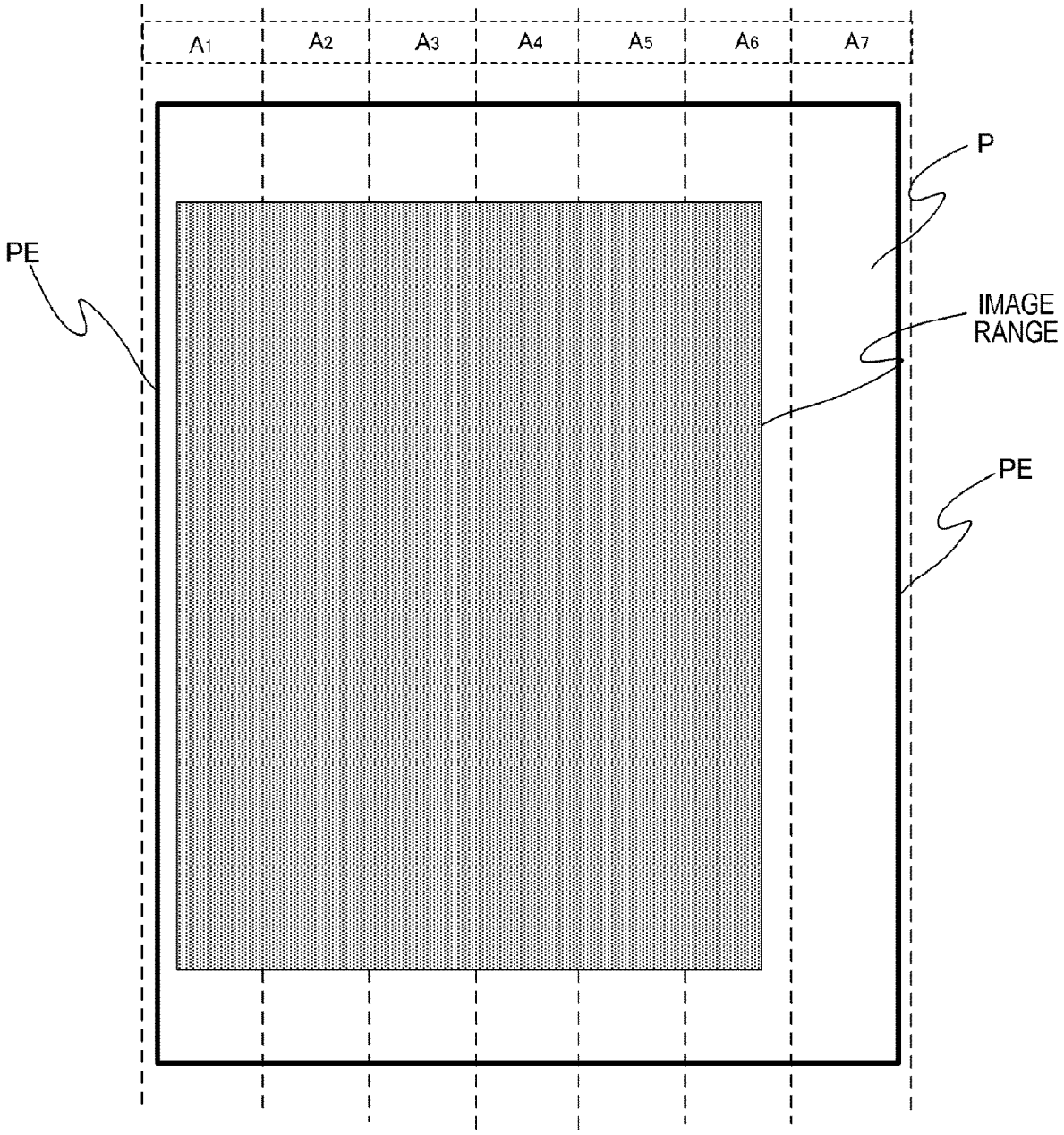

17A (LTR size: paper width 216 mm, paper length 279 mm, basis weight 75 g/m$^2$) will be described. Here, the heating regions $A_1$ to $A_6$ are determined as the image heating regions AI, and the heating region $A_7$ is determined as the non-image heating region AP, as indicated in FIG. 17B based on the image information. There is no image on the right end of the recording material P because in actual operation, an image is printed in the left justified state, and here conditions close to the actual operation state are used.

Figure 18A:
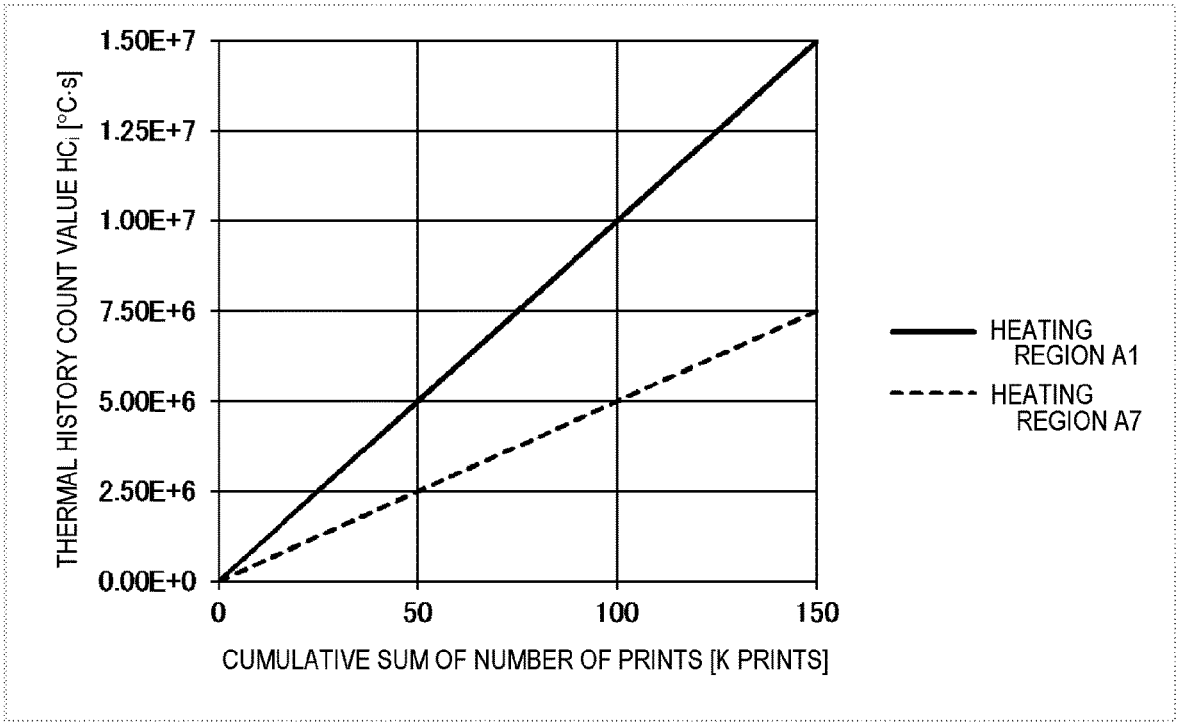
FIGS. 18A and 18B indicate graphs depicting a change in thermal history with respect to a cumulative sum of number of prints according to Example 2.
Figure 18B:
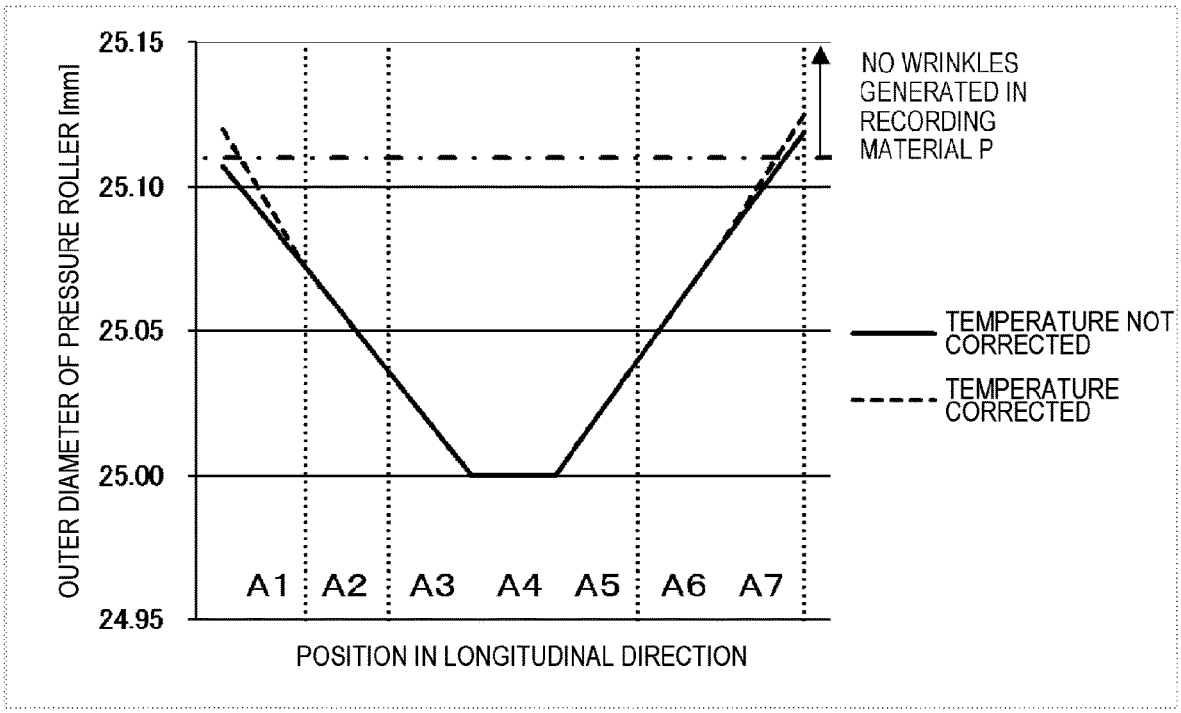

FIG. 18A indicates the change of the thermal history count value $HC_i$ of the heating region $A_i$ with respect to the cumulative sum of number of prints of the recording material P, and FIG. 18B indicates the outer diameter form of the pressure roller 208 after feeding 150K of recording material P. In FIG. 18A, the solid line indicates the change of the thermal history count value $HC_i$ of $A_i$ which is the image heating region, and the dotted line indicates the change of the thermal history count value $HC_i$ in $A_7$ which is the non-image heating region. When the cumulative sum of number of prints is 150K, the thermal history count value $HC_i$ of the heating region $A_1$ is $1.5\times10^7$ C·s and the inverted crown amount is 107 mm. The thermal history count value $HC_i$ of the heating region $A_7$ is $7.5\times10^6$ C·s, and the inverted crown amount is 119 μm. The thermal history count value $HC_i$ when the cumulative sum of number of prints is 150K is greater in the heating region $A_i$ than in the heating region $A_7$, and the inverted crown amount is smaller in the heating region $A_1$ than in the heating region $A_7$. The reason for this will be described next.

The control temperature in the heating region $A_1$ is the image portion reference temperature $T_{AI}$, and is 200° C. in Example 2. The control temperature in the heating region $A_7$ is the non-image portion reference temperature $T_{AP}$, and is 100° C. in Example 2. Comparing these reference temperatures, the image portion reference temperature $T_{AI}$ is higher. Therefore the amount of heating during printing in the heating region $A_1$ is higher than the heating region $A_7$, hence the thermal history count value $HC_i$ is also higher in the heating region $A_1$. As the control temperature in the heating region $A_i$ is higher, thermal deterioration of the pressure roller 208 becomes more pronounced, and the inverted crown amount decreases even more, hence the inverted crown amount decreases more in the heating region $A_1$ than in the heating region $A_7$.

When the recording material P illustrated in FIGS. 6A and 6B is printed using the fixing apparatus 200 of which cumulative sum of number of prints is 150K, the heating region $A_1$ and the heating region $A_7$ are determined as the non-image heating regions AP. The thermal history count value $HC_1$ in the heating region $A_1$ is $1.5\times10^7$ C·s, and the correction temperature $HA_1$ in the heating region $A_1$ is 15° C., as indicated in FIG. 16. The thermal history count value $HC_i$ in the heating region $A_7$ is $7.5\times10^6$ C·s, and the correction temperature $HA_7$ in the heating region $A_7$ is 7.5° C., as indicated in FIG. 16. FIG. 18B indicates the outer diameter form of the pressure roller 208 when the recording material P illustrated in FIGS. 6A and 6B is printed, and indicates the difference between the case when the above mentioned correction temperature is not added (solid line), and this correction temperature is added (long broken line). As indicated in FIG. 18B, when the correction temperature is not added, the inverted crown amount of the pressure roller 208 in the heating region $A_1$ is 107 μm, and this inverted crown amount in the heating region $A_7$ is 119 μm. Since the inverted crown amount in the heating region $A_1$ is less than 110 μm (dashed line in FIG. 18B), wrinkles are generated in the recording material P. In the case of adding the correction temperature, on the other hand, the inverted crown amount of the pressure roller 208 in the heating region $A_1$ is 120 μm, and this inverted crown amount in the heating region $A_7$ is 125 μm. Since the inverted crown amount is 110 mm or more on both ends, generation of wrinkles in the recording material P can be suppressed.

The thermal history count value $HC_i$ may be calculated based on the predicted pressure roller temperature in the heating region $A_i$. For example, in the case where the basis weight of the recording material is large, the thermal capacity of the recording material is large, hence the pressure roller temperature after printing becomes smaller compared with the case where the basis weight of the recording material is small. Therefore the pressure roller temperature in the heating region $A_i$ may be predicted based on such information as the control temperature in the heating region $A_i$, the heating control time, the basis weight of the control temperature recording material, and the printing speed, so as to set the thermal history count value $HC_i$ based on this predicted value.

By using the configuration of Example 2, the inverted crown amount of the pressure roller 208 can be predicted based on the thermal history count value $HC_i$, even if the inverted crown amount of the pressure roller 208 is different between the left and right in the longer direction due to the difference of the thermal history, as in the case of this application example. Therefore even if the cumulative sum of number of prints increases 50K more than 100K, which is the designed lifespan of the fixing apparatus 200, generation of wrinkles in the recording material P can be suppressed. In other words, the lifespan of the fixing apparatus 200 can be extended by 50K. As a consequence, by using the configuration of Example 2, both conserving power and longer lifespan of the fixing apparatus 200 can be implemented.

The configurations of the above examples and application examples may be combined as much as possible.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-080534, filed on Apr. 19, 2018, which is hereby incorporated by reference herein in its entirety.

What is claimed is:

1. An image heating apparatus comprising:

a heating unit which includes a heater having a plurality of heating elements arranged in a direction perpendicular to a transporting direction of a recording material, and heats an image formed on the recording material using the heat of the heater;

a pressure member which forms a nip portion by press-contacting the heating unit, and rotates, the pressure member having a circumference increasing from the center portion toward the ends in the arrangement direction of the plurality of heating elements; and a control portion which controls power supplied to each of the plurality of heating elements individually, wherein when the nip portion has a region through which the recording material passes, and a part of the region is an image heating region where an image region on the recording material passes through, and the rest of the region is a non-image heating region where a non-image region on the recording material passes through, the control portion controls power supplied to the heating elements corresponding to the non-image heating region, out of the plurality of heating elements, so as to maintain a control target temperature, which is set based on a used amount of the image heating apparatus, and wherein the control target temperature is a temperature at which an inverted crown amount, which is a difference between an outer diameter at the ends of the pressure member and an outer diameter at the center portion of the pressure member, is maintained at a predetermined amount.

2. The image heating apparatus according to claim 1, wherein the control target temperature which is used for supplying power to a heating element corresponding to the non-image heating region is set to a higher value as the used amount of the image heating apparatus increases.

3. The image heating apparatus according to claim 1, wherein the control target temperature which is used for supplying power to a heating element corresponding to the non-image heating region is set to a lower value than the control target temperature which is used for supplying power to a heating element corresponding to the image heating region.

4. The image heating apparatus according to claim 1, wherein the control portion sets the control target temperature which is used for supplying power to a heating element corresponding to the non-image heating region to a higher value as the non-image heating region is closer to the ends of the pressure member in the arrangement direction of the plurality of heating elements.

5. The image heating apparatus according to claim 1, wherein the control portion includes an acquiring portion which acquires information used for controlling the temperature of a plurality of heating regions heated by the plurality of heating elements, wherein the acquiring portion acquires the used amount from a cumulative sum of number of prints of the recording material on which an image is heated by the image heating apparatus or from an accumulated length of movement of the pressure member.

6. The image heating apparatus according to claim 5, wherein the acquiring portion acquires information on thermal history of each of the plurality of heating regions, wherein the control target temperature which is used for supplying power to a heating element corresponding to the non-image heating region is set based not only on the used amount, but also on the information the thermal history in the non-image heating region.

7. The image heating apparatus according to claim 6, wherein the control target temperature which is used for supplying power to a heating element corresponding to the non-image heating region is set to a higher value as the frequency of heating in the non-image heating region is higher.

8. The image heating apparatus according to claim 6, wherein the information on the thermal history is acquired based on at least one of the control target temperature, time spent for heat control, and amount of power consumed by the heating elements in the heating region.

9. The image heating apparatus according to claim 1, wherein the heating unit includes a tubular film, which rotates with the inner surface thereof contacting the heater, and an image on the recording material is heated via the film.

10. An image forming apparatus comprising:

an image forming portion which forms an image on a recording material; and a fixing portion which fixes the image formed on the recording material to the recording material, wherein the fixing portion includes a heating unit which includes a heater having a plurality of heating elements arranged in a direction perpendicular to a transporting direction of the recording material, and heats an image formed on the recording material using the heat of the heater;

a pressure member which forms a nip portion by press-contacting the heating unit, and rotates, the pressure member having a circumference increasing from the center portion toward the ends in the arrangement direction of the plurality of heating elements; and a control portion which controls power supplied to each of the plurality of heating elements individually, wherein when the nip portion has a region through which the recording material passes, and a part of the region is an image heating region where an image region on the recording material passes through, and the rest of the region is a non-image heating region where a non-image region on the recording material passes through, the control portion controls power supplied to the heating elements corresponding to the non-image heating region, out of the plurality of heating elements, so as to maintain a control target temperature, which is set based on a used amount of the image heating apparatus, and wherein the control target temperature is a temperature at which an inverted crown amount, which is a difference between an outer diameter at the ends of the pressure member and an outer diameter at the center portion of the pressure member, is maintained at a predetermined amount.

* * * * *